US010835878B2

(12) United States Patent
Wild et al.

(10) Patent No.: US 10,835,878 B2
(45) Date of Patent: Nov. 17, 2020

(54) BIFURCATING MIXERS AND METHODS OF THEIR USE AND MANUFACTURE

(71) Applicant: The University of British Columbia, Vancouver (CA)

(72) Inventors: Andre Wild, Vancouver (CA); Timothy Leaver, Delta (CA); Robert James Taylor, Vancouver (CA)

(73) Assignee: The University of British Columbia, Vancouver (CA)

( * ) Notice: Subject to any disclaimer, the term of this patent is extended or adjusted under 35 U.S.C. 154(b) by 0 days.

(21) Appl. No.: 15/931,901

(22) Filed: May 14, 2020

(65) Prior Publication Data

US 2020/0269201 A1 Aug. 27, 2020

Related U.S. Application Data

(63) Continuation of application No. 16/102,518, filed on Aug. 13, 2018, which is a continuation of application
(Continued)

(51) Int. Cl.
*B01F 5/06* (2006.01)
*B01F 13/00* (2006.01)

(52) U.S. Cl.
CPC ..... *B01F 5/0645* (2013.01); *B01F 5/064* (2013.01); *B01F 5/0647* (2013.01);
(Continued)

(58) Field of Classification Search
CPC ..... B01F 13/0059; B01F 2005/0621; B01F 2005/0623; B01F 2215/0422;
(Continued)

(56) References Cited

U.S. PATENT DOCUMENTS 3,159,312 A 12/1964 Sciver, II
3,394,924 A 7/1968 Harder
(Continued)

FOREIGN PATENT DOCUMENTS

CA 2 918 368 A1 1/2015
CA 2 927 358 A1 4/2015
(Continued)

OTHER PUBLICATIONS

International Search Report and Written Opinion dated Nov. 2, 2016, issued in corresponding International Application No. PCT/CA2016/050997, filed Aug. 24, 2016, 6 pages.
(Continued)

*Primary Examiner* — Tony G Soohoo
(74) *Attorney, Agent, or Firm* — Christensen O'Connor Johnson Kindness PLLC

(57) ABSTRACT

Disclosed herein are fluidic mixers having bifurcated fluidic flow through toroidal mixing elements. The mixers operate, at least partially, by Dean vortexing. Accordingly, the mixers are referred to as Dean Vortex Bifurcating Mixers ("DVBM"). The DVBM utilize Dean vortexing and asymmetric bifurcation of the fluidic channels that form the mixers to achieve the goal of optimized microfluidic mixing. The disclosed DVBM mixers can be incorporated into any fluidic (e.g., microfluidic) device known to those of skill in the art where mixing two or more fluids is desired. The disclosed mixers can be combined with any fluidic elements known to those of skill in the art, including syringes, pumps, inlets, outlets, non-DVBM mixers, heaters, assays, detectors, and the like.

20 Claims, 23 Drawing Sheets

Related U.S. Application Data

No. 15/522,720, filed as application No. PCT/CA2016/050997 on Aug. 24, 2016, now Pat. No. 10,076,730.

(60) Provisional application No. 62/275,630, filed on Jan. 6, 2016.

(52) U.S. Cl.
CPC ..... *B01F 5/0655* (2013.01); *B01F 5/0656* (2013.01); *B01F 13/0059* (2013.01); *B01F 2005/0621* (2013.01); *B01F 2005/0623* (2013.01); *B01F 2215/0422* (2013.01); *B01F 2215/0431* (2013.01); *B01F 2215/0459* (2013.01)

(58) Field of Classification Search
CPC ..... B01F 2215/0431; B01F 2215/0459; B01F 5/064; B01F 5/0645; B01F 5/0655; B01F 5/0656; B01F 5/0647
See application file for complete search history.

(56) References Cited

U.S. PATENT DOCUMENTS

| | | | |
|---|---|---|---|
| 3,404,869 | A | 10/1968 | Harder |
| 3,574,485 | A | 4/1971 | Herman, Jr. |
| 3,855,368 | A | 12/1974 | Prochazka et al. |
| 3,927,868 | A | 12/1975 | Moore |
| 4,027,857 | A | 6/1977 | Cunningham |
| 4,629,589 | A | 12/1986 | Gupta et al. |
| 4,732,585 | A | 3/1988 | Lerner |
| RE33,444 | E | 11/1990 | Lerner |
| 5,335,992 | A | 8/1994 | Holl |
| 6,331,072 | B1 | 12/2001 | Schierholz et al. |
| 6,399,031 | B1 | 6/2002 | Herrmann et al. |
| 6,457,854 | B1 | 10/2002 | Koop et al. |
| 8,864,367 | B2 | 10/2014 | Hanada et al. |
| 9,142,662 | B2 | 9/2015 | Ryu et al. |
| 9,500,664 | B2 | 11/2016 | Ness et al. |
| 10,041,091 | B2 | 8/2018 | Cullis et al. |
| 2002/0023841 | A1 | 2/2002 | Ahn et al. |
| 2002/0187074 | A1 | 12/2002 | O'Connor et al. |
| 2003/0040105 | A1 | 2/2003 | Sklar et al. |
| 2004/0037161 | A1 | 2/2004 | Honda et al. |
| 2004/0191086 | A1 | 9/2004 | Paukovits, Jr. et al. |
| 2004/0238355 | A1 | 12/2004 | Kimizuka |
| 2004/0248291 | A1 | 12/2004 | Yamamoto et al. |
| 2004/0265184 | A1 | 12/2004 | Matsuda et al. |
| 2006/0087048 | A1 | 4/2006 | Mello et al. |
| 2006/0101775 | A1 | 5/2006 | Miyake et al. |
| 2006/0171864 | A1 | 8/2006 | Caze et al. |
| 2006/0280029 | A1 | 12/2006 | Garstecki et al. |
| 2007/0017633 | A1 | 1/2007 | Tonkovich et al. |
| 2007/0081923 | A1 | 4/2007 | Choe et al. |
| 2007/0089460 | A1 | 4/2007 | Lindig et al. |
| 2007/0225532 | A1 | 9/2007 | Tonkovich et al. |
| 2009/0087509 | A1 | 4/2009 | Linares |
| 2009/0142846 | A1 | 6/2009 | Crenshaw et al. |
| 2010/0022680 | A1 | 1/2010 | Kamik et al. |
| 2011/0003325 | A1 | 1/2011 | Durack |
| 2011/0315227 | A1 | 12/2011 | Shu |
| 2012/0085644 | A1 | 4/2012 | Renzi et al. |
| 2012/0115755 | A1 | 5/2012 | Oh et al. |
| 2012/0121481 | A1 | 5/2012 | Romanowsky et al. |
| 2012/0174772 | A1 | 7/2012 | Knobel |
| 2012/0276209 | A1 | 11/2012 | Cullis et al. |
| 2012/0300576 | A1 | 11/2012 | Li et al. |
| 2013/0236375 | A1 | 9/2013 | Tan et al. |
| 2013/0260474 | A1 | 10/2013 | Chan et al. |
| 2014/0038214 | A1 | 2/2014 | Neeves et al. |
| 2015/0025461 | A1 | 1/2015 | Corso et al. |
| 2015/0297834 | A1 | 10/2015 | Buder et al. |
| 2016/0022580 | A1 | 1/2016 | Ramsay et al. |
| 2016/0068883 | A1 | 3/2016 | Luo et al. |
| 2016/0130640 | A1 | 5/2016 | Wright et al. |

FOREIGN PATENT DOCUMENTS

| | | | |
|---|---|---|---|
| CN | 102151504 | A | 8/2011 |
| CN | 102753257 | A | 10/2012 |
| CN | 103906503 | A | 7/2014 |
| DE | 103 56 308 | A1 | 6/2005 |
| JP | 2008246283 | A | 10/2008 |
| JP | 2009166039 | A | 7/2009 |
| JP | 2011183381 | A | 9/2011 |
| JP | 2012520174 | A | 9/2012 |
| JP | 2013510096 | A | 3/2013 |
| JP | 2014517513 | A | 7/2014 |
| JP | 2015502337 | A | 1/2015 |
| WO | 2008/039209 | A1 | 4/2008 |
| WO | 2013111789 | A1 | 8/2013 |
| WO | 2014/172045 | A1 | 10/2014 |

OTHER PUBLICATIONS

International Preliminary Report on Patentability dated Aug. 29, 2017, issued in corresponding International Application No. PCT/US2016/019414, filed Feb. 24, 2016, 12 pages.

International Preliminary Report on Patentability dated Nov. 9, 2017, issued in corresponding International Application No. PCT/US2016/029879, filed Apr. 28, 2016, 15 pages.

Partial Search Report and Invitation to Pay Additional Fees dated Sep. 21, 2018, issued in corresponding European Application No. 16756307.1, filed Feb. 24, 2016, 23 pages.

First Office Action dated Jun. 24, 2019, issued in corresponding Chinese Application No. 201680022904.1, filed Feb. 24, 2016, 6 pages.

Search Report dated dated Jun. 24, 2019, issued in corresponding Chinese Application No. 201680022904.1, filed Feb. 24, 2016, 3 pages.

Supplementary European Search Report dated Aug. 1, 2019, issued in corresponding European Application No. 16882817.6, filed Aug. 24, 2016, 9 pages.

Chen et al., "Optimal Designs of Staggered Dean Vortex Micromixers," International Journal of Molecular Sciences 12(6):3500-3524, Jan. 11, 2011.

Deshpande, A., "Polystyrene Properties," Buzzle, Feb. 1, 2013, <http://www.buzzle.com/articles / polystyreneproperties.html> [retrieved Jul. 11, 2016], pp. 1-6; especially p. 3, table entitled "Mechanical Properties.".

Extended European Search Report dated Feb. 8, 2019, issued in corresponding European Application No. 16756307.1, filed Feb. 24, 2016, 17 pages.

Howell, P.B. Jr., et al., "Design and Evaluation of a Dean Vortex-Based Micromixer," Lab on a Chip 4(6):663-669, Dec. 2004.

International Search Report and Written Opinion dated May 17, 2016, issued in corresponding International Application No. PCT/US2016/19414, filed Feb. 24, 2016, 20 pages.

International Search Report and Written Opinion dated Sep. 2, 2016, issued in corresponding International Application No. PCT/US2016/29879, filed Apr. 28, 2016, 18 pages.

Extended European Search Report dated Dec. 14, 2018, issued in corresponding European Application No. 16787188.8, filed Apr. 28, 2016, 9 pages.

Machine translation of Notice of Reasons for Refusal, dated Dec. 24, 2019, issued in corresponding Japanese Application No. 2017-544579, filed Feb. 24, 2016, 11 pages.

Second Non-Final Rejection, dated Dec. 27, 2019, issued in U.S. Appl. No. 15/552,473, filed Aug. 21, 2017, 11 pages.

First Office Action, dated May 19, 2020, issued in corresponding Chinese Application No. 201680031630.2, filed Apr. 28, 2016, 26 pages.

Examination Report No. 1 for Standard Patent Application, dated Jun. 24, 2020, issued in corresponding Australian Application No. 2016222746, filed Feb. 24, 2016, 4 pages.

(56) References Cited

OTHER PUBLICATIONS

Machine translation Chinese First Office Action, dated Jul. 13, 2020, issued in corresponding Chinese Application No. 201680083280.4, filed Aug. 24, 2016, 15 pages.
Final Office Action dated Jul. 9, 2020, issued in corresponding U.S. Appl. No. 14/552,473, filed Aug. 21, 2017, 13 pages.
Third Chinese Office Action, dated Aug. 14, 2020, issued in corresponding Chinese Application No. 2016800229041, filed Feb. 24, 2016, 18 pages.
Notice of Reasons for Rejection, dated Sep. 7, 2020, issued in corresponding Japanese Application No. 2018-535128, filed Aug. 24, 2016, 11 pages.

BIFURCATING MIXERS AND METHODS OF THEIR USE AND MANUFACTURE

CROSS-REFERENCES TO RELATED APPLICATIONS

This application is a continuation of U.S. patent application Ser. No. 16/102,518, filed on Aug. 13, 2018, which is a continuation of U.S. patent application Ser. No. 15/522,720, filed on Apr. 27, 2017 (now U.S. Pat. No. 10,076,730), which is a national stage application of International Application No. PCT/CA2016/050997, filed Aug. 24, 2016, which claims the benefit of U.S. Provisional Patent Application No. 62/275,630, filed on Jan. 6, 2016, the disclosures of which are hereby incorporated by reference in their entireties.

BACKGROUND

Recent developments have seen high-performance microfluidic mixers used for manufacturing nanoparticles at industrially relevant flow rates (e.g. 10-12 mL/min). While these mixers have seen significant adoption in the drug development market, the mixers used at present are difficult to manufacture and have certain performance limitations. At the same time, there is a market for a mixer that can work at much smaller volumes (on the order of one hundred microliters). The high flow rate required to operate existing mixers, along with the volume lost, make them unsuited for such an application. One solution would be to miniaturize existing technologies, such as a Staggered Herringbone Mixer (SHM), with smaller dimensions. However, such a device would require features <50 μm, which would be hard to fabricate using the tools traditionally used for machining injection molding tools (the preferred method of mass production of plastic microfluidic devices).

In view of the inherent difficulties of miniaturizing traditional microfluidic mixers, new mixer designs that enable inexpensive manufacturing are needed to continue commercial expansion of microfluidic mixer use.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Disclosed in certain embodiments herein are new configurations of microfluidic devices that operate as efficient mixers. In certain embodiments these new mixers can be fabricated using injection-molding tooling, which allows for inexpensive and efficient manufacture of the devices.

In one aspect, a mixer operating by Dean vortexing to mix at least a first liquid and a second liquid is provided, the mixer comprising an inlet channel leading into a plurality of toroidal mixing elements arranged in series, wherein the plurality of toroidal mixing elements includes a first toroidal mixing element downstream of the inlet channel, and a second toroidal mixing element in fluidic communication with the first toroidal mixing element via a first neck region, and wherein the first toroidal mixing element defines a first neck angle between the inlet channel and the first neck region.

In another aspect, methods of using the mixers disclosed herein are provided. In one embodiment, the method includes mixing a first liquid with a second liquid by flowing (e.g., impelling or urging) a first liquid and a second liquid through a mixer as disclosed herein to produce a mixed solution.

In another aspect, methods of manufacturing the mixers are provided. In one embodiment, a method is provided that includes forming a master mold using an endmill, wherein the master mold is configured to form DVBM mixers according to the embodiments disclosed herein.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
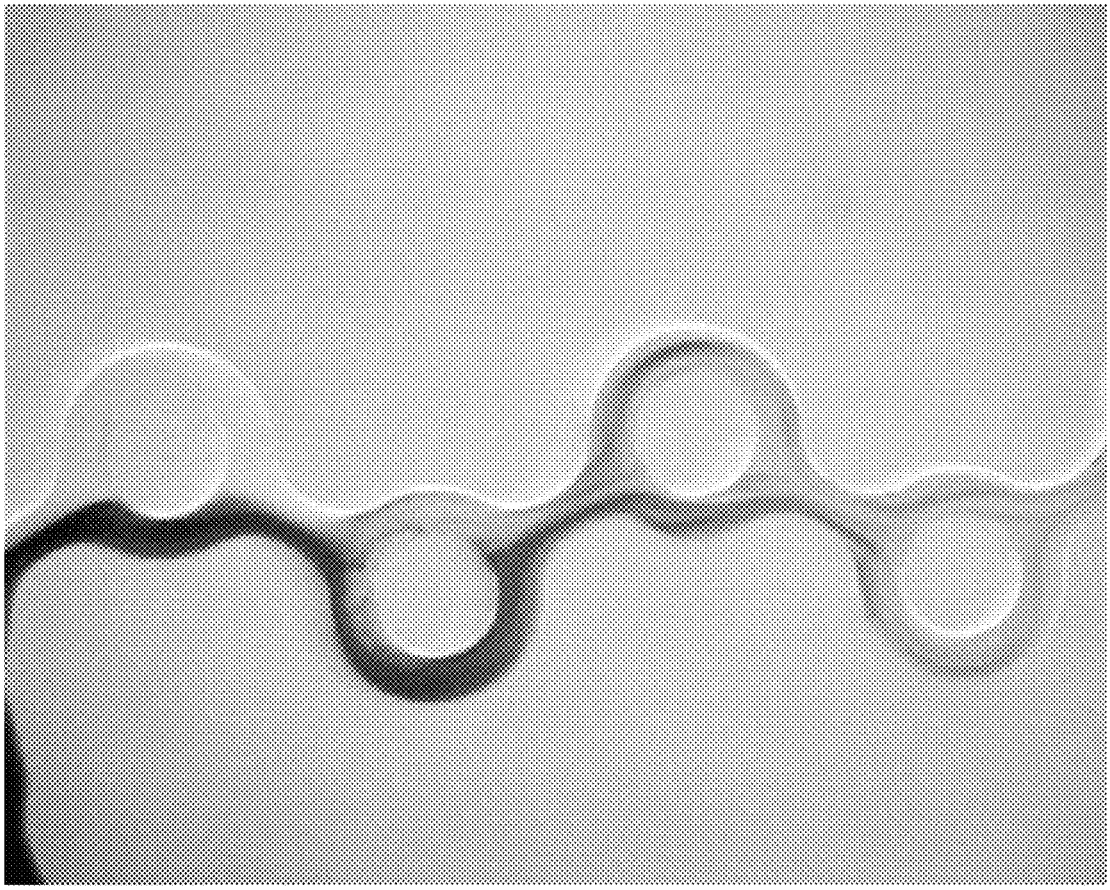
FIG. 1 is a micrograph of an exemplary Dean Vortex Bifurcating Mixers ("DVBM") mixer mixing two liquids in accordance with embodiments disclosed herein.

When fluid flows through a curved channel, fluid towards the centre of the channel is pushed outward due to centripetal force and the higher velocity of the fluid at this location (caused by the no-slip boundary conditions). The action of these forces causes rotation of the fluid perpendicular to the channel in a form known as Dean vortexing.

Disclosed herein are fluidic mixers having bifurcated fluidic flow through toroidal mixing elements. The mixers operate, at least partially, by Dean vortexing. Accordingly, the mixers are referred to as Dean Vortex Bifurcating Mixers ("DVBM"). The DVBM utilize Dean vortexing and asymmetric bifurcation of the fluidic channels that form the mixers to achieve the goal of optimized microfluidic mixing. The disclosed DVBM mixers can be incorporated into any fluidic (e.g., microfluidic) device known to those of skill in the art where mixing two or more fluids is desired. The disclosed mixers can be combined with any fluidic elements known to those of skill in the art, including syringes, pumps, inlets, outlets, non-DVBM mixers, heaters, assays, detectors, and the like.

The provided DVBM mixers include a plurality of toroidal mixing elements (also referred to herein as "toroidal mixers." As used herein, "toroid" refers to a generally circular structure having two "leg" channels that define a circumference of the toroid between an inlet and an outlet of the toroidal mixer. The toroidal mixers are circular in certain embodiments. In other embodiments, the toroidal mixers are not perfectly circular and may instead have oval or non-regular shape.

In one aspect, a mixer operating by Dean vortexing to mix at least a first liquid and a second liquid is provided, the mixer comprising an inlet channel leading into a plurality of toroidal mixing elements arranged in series, wherein the plurality of toroidal mixing elements includes a first toroidal mixing element downstream of the inlet channel, and a second toroidal mixing element in fluidic communication with the first toroidal mixing element via a first neck region, and wherein the first toroidal mixing element defines a first neck angle between the inlet channel and the first neck region.

In the DVBM, two (or more) fluids enter into the mixer, e.g., via an inlet channel, from two (or more) separate inlets each bringing in one of the two (or more) fluids to be mixed. The two fluids flow into and are initially combined in one region, but then encounter a bifurcation in the path of flow into two curved channels of different lengths. These two curved channels are referred to herein as "legs" of a toroidal mixer. The different lengths have different impedances (impedance herein defined as pressure/flow rate (e.g., (PSI*min)/mL). In one embodiment, the ratio of impedance in the first leg compared to second leg is from about 1:1 to about 10:1. This imbalance causes more fluid to enter one leg than the other. The imbalance of impedance results in a volume ratio in the two legs, which ratio is very similar to the impedance ratio. Accordingly, in one embodiment, the ratio of volume flow in the first leg compared to the second leg is from about 1:1 to about 10:1. Impedance (or impedance per length*viscosity) is fairly independent of device operation.

If the cross section of the legs is the same, then differing impedance is achieved by different length and mixing occurs. If there is a true 1:1 impedance, then the volumes split equally between the legs, but mixing still occurs by Dean vortexing; however, in such a situation the benefit of bifurcation are not utilized in full.

An exemplary DVBM having a series of four toroidal mixers is pictured in FIG. 1.

In one embodiment, the channels (e.g., legs) of the mixer are of about uniform latitudinal cross-sectional area (e.g., height and width). The channels can be defined using standard width and height measurements. In one embodiment, the channels have a width of about 100 microns to about 500 microns and a height of about 50 microns to about 200 microns. In one embodiment, the channels have a width of about 200 microns to about 400 microns and a height of about 100 microns to about 150 microns. In one embodiment, the channels have a width of about 100 microns to about 1 mm and a height of about 100 microns to about 1 mm. In one embodiment, the channels have a width of about 100 microns to about 2 mm and a height of about 100 microns to about 2 mm.

In other embodiment, channel areas vary within an individual toroid or within a toroid pair. Hydrodynamic diameter is often used to characterize microfluidic channel dimensions. As used herein, hydrodynamic diameter is defined using channel width and height dimensions as (2*Width*Height)/(Width+Height). In one embodiment, the channels of the mixer have a hydrodynamic diameter of about 20 microns to about 2 mm. In one embodiment, the channels of the mixer have a hydrodynamic diameter of about 20 microns to about 1 mm. In one embodiment, the channels of the mixer have a hydrodynamic diameter of about 20 microns to about 300 microns. In one embodiment, the channels of the mixer have a hydrodynamic diameter of about 113 microns to about 181 microns. In one embodiment, the channels of the mixer have a hydrodynamic diameter of about 150 microns to about 300 microns. In one embodiment, the channels of the mixer have a hydrodynamic diameter of about 1 mm to about 2 mm. In one embodiment, the channels of the mixer have a hydrodynamic diameter of about 500 microns to about 2 mm.

In one embodiment, the mixer is a microfluidic mixer, wherein the legs of the toroidal mixing elements have microfluidic dimensions.

In order to maintain laminar flow and keep the behavior of solutions in the microfluidic devices predictable and the methods repeatable, the systems are designed to support flow at low Reynolds numbers. In one embodiment, the first mixer is sized and configured to mix the first solution and the second solution at a Reynolds number of less than 2000. In one embodiment, the first mixer is sized and configured to mix the first solution and the second solution at a Reynolds number of less than 1000. In one embodiment, the first mixer is sized and configured to mix the first solution and the second solution at a Reynolds number of less than 900. In one embodiment, the first mixer is sized and configured to mix the first solution and the second solution at a Reynolds number of less than 500.

Figure 2:
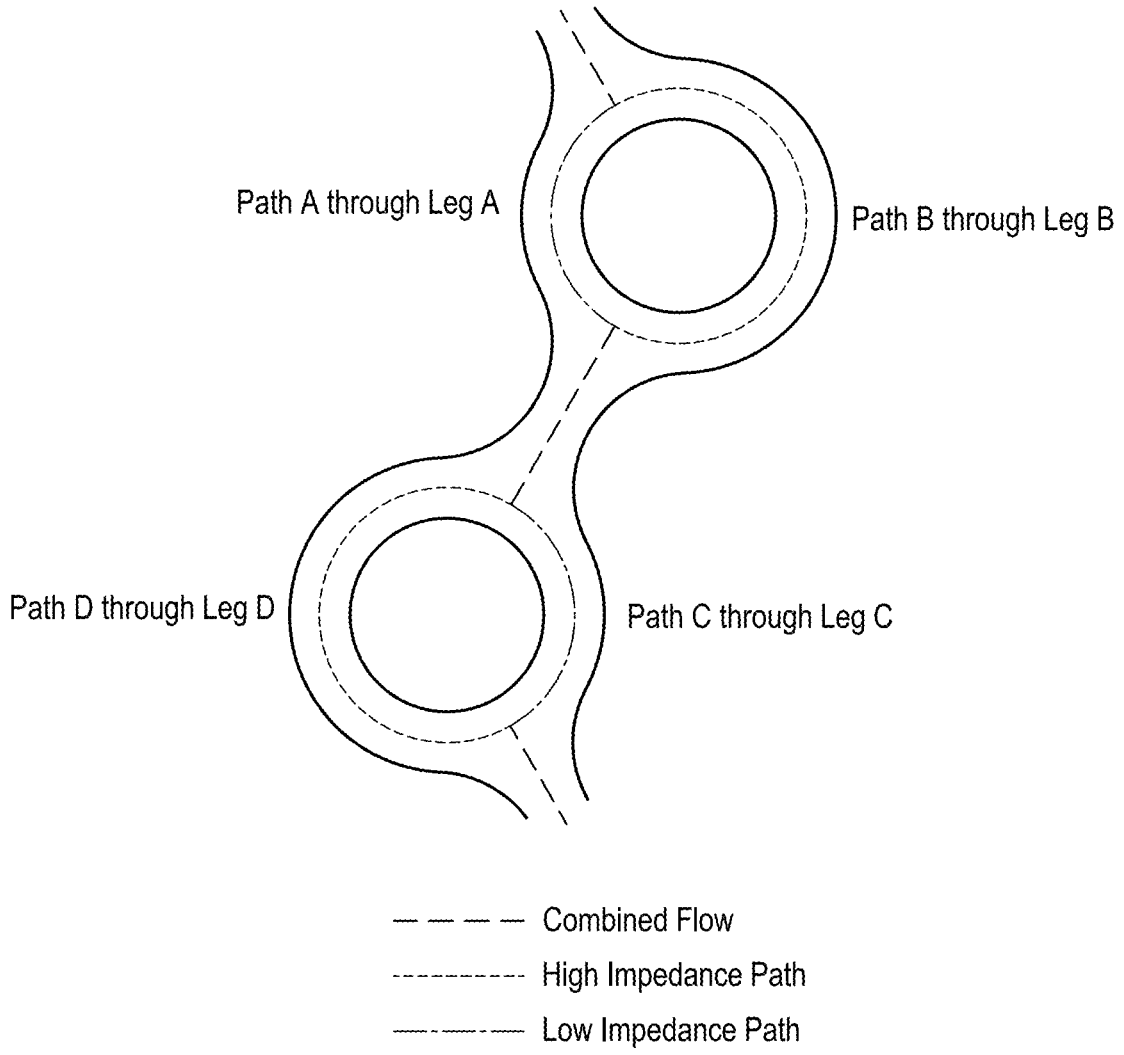
FIGS. 2-4 are diagrammatic illustrations of portions of DVBM mixers in accordance with embodiments disclosed herein.
Figure 3:
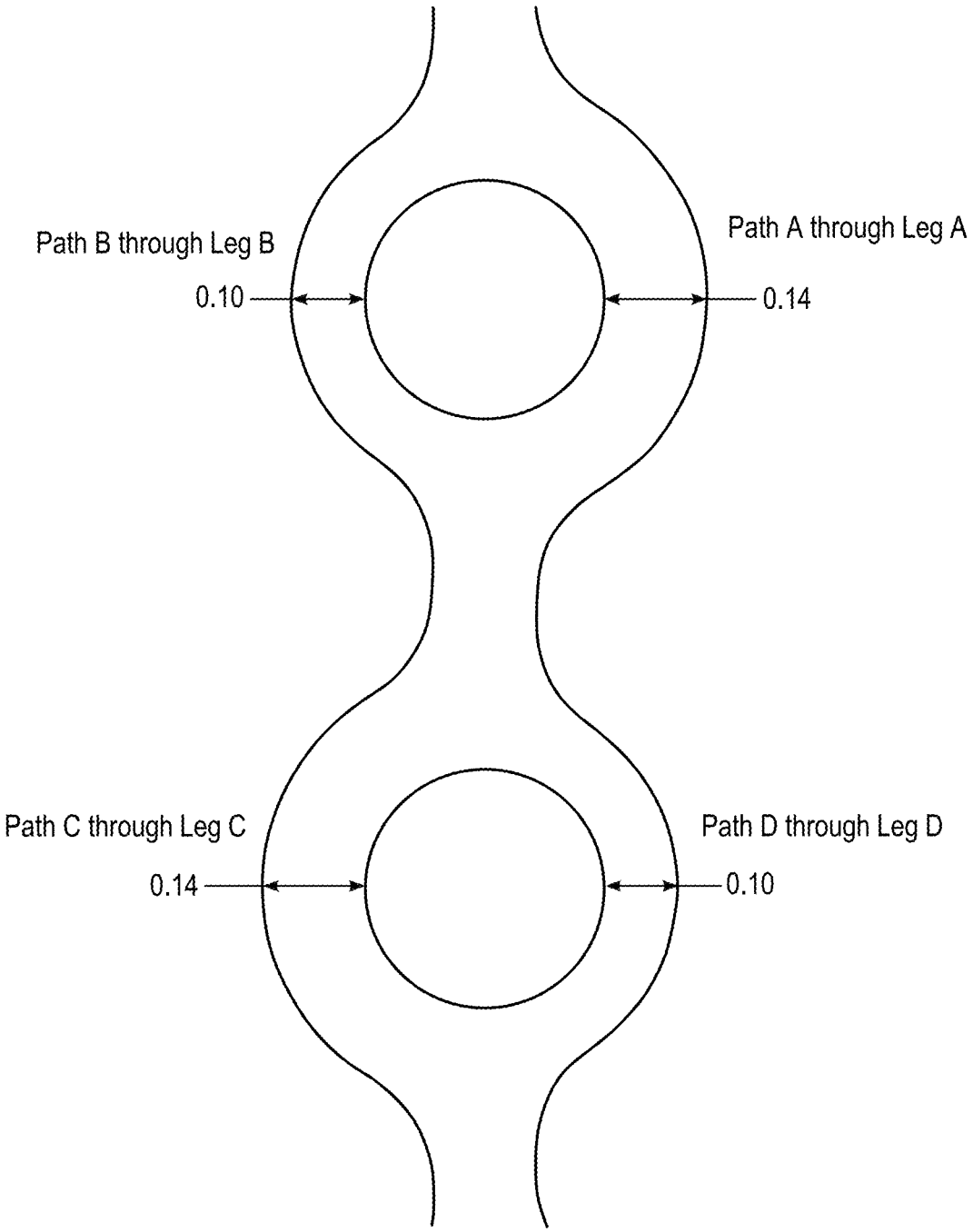

Referring to FIG. 2 and FIG. 3, illustrative devices are provided in order to better explain the embodiments disclosed herein. FIG. 2 diagrammatically illustrates impedance difference obtained by changing channel length in a DVBM. In this case, there are four different path lengths: $L_a$ for Path A, $L_b$ for Path B, $L_c$ for Path C and $L_d$ for Path D. The impedance ratio for the first toroid will therefore be $L_b$:$L_a$ and $L_c$:$L_d$. FIG. 3 diagrammatically illustrates impedance difference obtained by varying channel width in a DVBM. In this case, there are four different channel widths: $w_a$ for Path A, $w_b$ for Path B, $w_c$ for Path C and $w_d$ for Path D. The impedance ratio of the first toroid pair will therefore be (approximately) $w_a$:$w_b$ and $w_c$:$w_d$.

The illustrated mixers include two toroidal mixing elements, each defined by four "legs" (A-D) through which fluid will flow along the four "paths" (A-D) for the fluid created by the legs. The impedance imbalance resulting from the paths created in the devices causes more fluid to pass through Path A (in Leg A) than through Path B (in Leg B). These curved channels are designed to induce Dean vortexing. Upon exiting these curved channels, the fluid is again recombined and split by a second bifurcation. As before, this split leads to two channels of differing impedances, however; this time the ratio of their impedances has been inverted. In FIG. 2, Path C (through Leg C) would have less impedance than Path D (through Leg D) and equal to that of Path A. Likewise, Path D and Path B would be matched. As a result, Path C will contain fluids from both Path A and Path B. When this pattern of bifurcations leading to alternating impedances is repeated over several cycles, the two fluids are "kneaded" together (e.g., as visually illustrated by the color changes in FIG. 1), resulting in increased contact area between the two and thus decreased mixing time. This kneading is the same mechanism used by a staggered herringbone mixer (SHM), but accomplishes it using simpler, planar structures.

As illustrated in FIG. 2, the length of the two legs of a toroidal mixing element combine to total the circumference of the toroid defined through a center line of the width of the channels of the two legs. The two points at which the legs meet (e.g., the start and end of the flow path of the toroidal mixing element) are defined by where a centerline through the inlet, outlet, or neck meets the toroid. See FIG. 2, where the "combined flow" lines meet the "paths."

The pressure loss over a given length of a channel is given by the equation:

$$\Delta P = R_H Q$$

where $R_H$=hydraulic resistance and $Q$=volumetric flow rate for a channel of width w and height h (where h<w)

$$R_H \approx \frac{12\mu L}{wh^3\left(1 - 0.63\frac{h}{w}\right)}$$

where μ is the fluid viscosity and L is the channel length. From this expression it is clear that the impedance ratio can be achieved by varying any of L (FIG. 2) or w (FIG. 3) if h is held constant.

Figure 4:
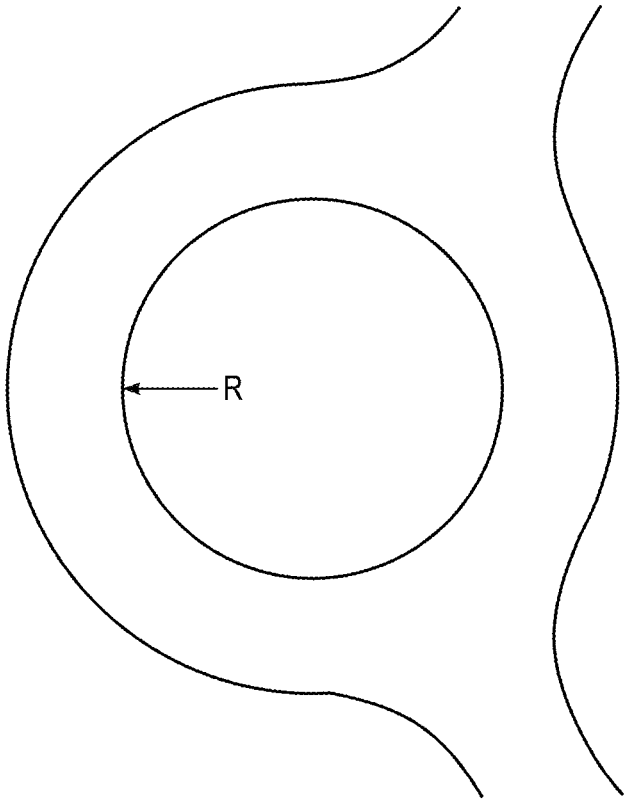

The term "inner radius" (R) is defined as the radius of the inside of the toroid feature. FIG. 4 diagrammatically illustrates the inner radius (R) of a toroidal mixing element.

The outer radius of a toroid is defined as the inner radius plus the width of the leg channel through which the radius is measured. As noted elsewhere herein, in certain embodiment the two legs of a toroid are the same width; in other embodiments the two legs have different widths. Therefore, a single toroid may have a radius that differs depending on the measurement location. In such embodiments, the outer radius may be defined by the average of the outer radii around the toroid. The largest radius of a variable-radius toroid is defined as half the length of a line joining the furthest points on opposite sides of the center of the toroid.

In one embodiment, the mixer includes a plurality of toroidal mixing elements ("toroids"). In one embodiment, the plurality of toroids all have about the same radius. In one embodiment, not all of the toroids have about the same radius. In one embodiment the mixer includes one or more pairs of toroids. In one embodiment the two toroids in the pairs of toroids have about the same radii. In another embodiment, the two toroids have different radii. In one embodiment, the mixer includes a first pair and a second pair. In one embodiment, the radii of the toroids in the first pair are about the same as the radii of the toroids in the second pair. In another embodiment, the radii of the toroids in the first pair are not about the same as the radii of the toroids in the second pair.

Figure 5:
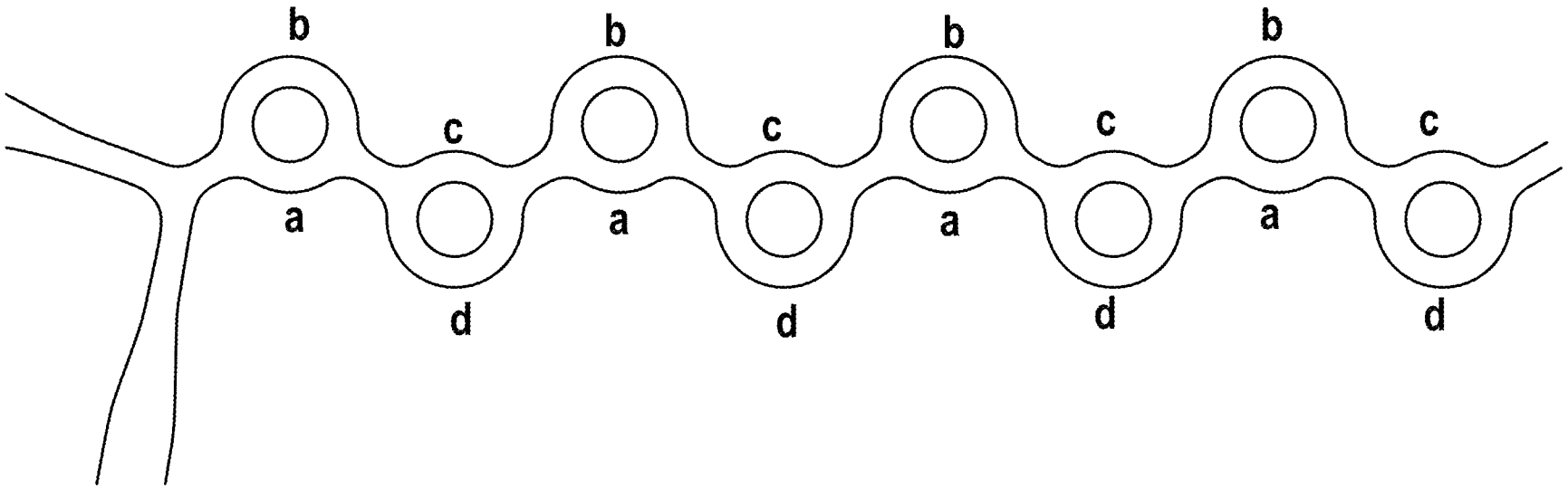
FIG. 5 is an illustration of an exemplary DVBM mixer in accordance with embodiments disclosed herein.

The mixers disclosed herein include two or more toroids in order to adequately mix the two or more liquids moved through the mixers. In certain embodiments, the mixer includes a foundational structure that is two toroids linked together as a pair (e.g., as illustrated in FIG. 5). The two toroids are linked by a neck at a neck angle. In one embodiment, the mixer includes from 1 to 10 pairs of toroids (i.e., 2 to 20 toroids), wherein the pairs are defined as having about the same characteristics (although the two toroids in each pair may be different), in terms of impedance, structure, and mixing ability. In one embodiment, the mixer includes from 2 to 8 pairs of toroids. In one embodiment, the mixer includes from 2 to 6 pairs of toroids In another embodiment, whether the toroids are arranged in pairs or not, the mixer includes from 2 to 20 toroids.

FIG. 5 is a representative mixer that includes a series of repeating pairs of toroids, 8 total toroids in 4 pairs. In each pair, the first toroid has "legs" of length a and b, in the second toroid the legs have length c and d. In one embodiment, lengths a and c are equal and b and d are equal. In another embodiment, the ratio of a:b equals c:d. The mixer of FIG. 5 is an example of a mixer with uniform channel width, toroid radii, neck angle (120 degrees), and neck length.

Figure 6:
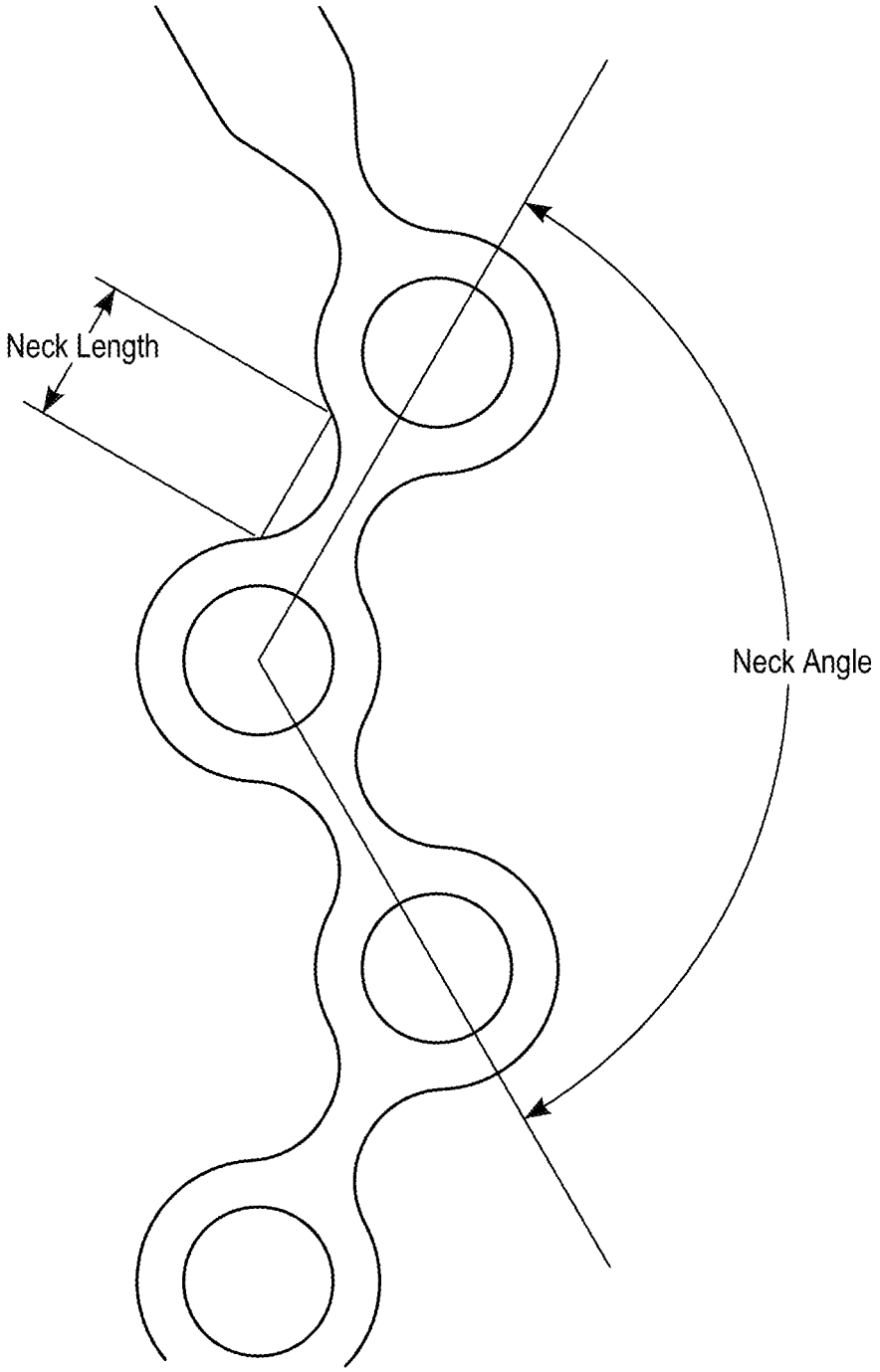
FIG. 6 is a diagrammatic illustration of a portion of a DVBM mixer in accordance with embodiments disclosed herein.

The lengths of the legs of the toroids can be the same or different between pairs of toroids. Referring to FIG. 2 and FIG. 6, the two legs of at least one toroid are different, so as to produce a neck angle. In one embodiment the legs of the first toroid in a mixer are from 0.1 mm to 2 mm. In another embodiment, all of the legs of the toroids in the mixer are within this range.

In its simplest form, a mixer that makes use of Dean vortexing includes a series of toroids without any "neck" between the toroids. However, this simplistic concept would result in a sharp, "knife-edge" feature where the two toroids meet. It would not be possible to machine a mould for such a feature using standard machining techniques. The two simplest means for overcoming this would be to introduce a radius to this feature (where the radius would be the same as that of the end mill used) or to create a channel region, or "neck", between the toroids. As is shown by measurements of the mixing speed (see Exemplary Device Testing and Results section below), both of these modifications result in reduced mixing performance. This performance loss is likely due to the loss of the sudden change in direction that fluid is forced to make in order to enter the next toroid. In order to overcome this loss in performance, the DVBM uses an angled "neck" between the toroids.

Neck angle is defined as the shortest angle formed in relation to the center of each toroid defined by the lines passing through the center of the entrance channel and the exit channel of each toroid. FIG. 6 diagrammatically illustrates measurement of the neck angle in the disclosed embodiments.

Each pair of toroids is structured according to the neck angle between them. In toroids adjacent to an inlet or outlet channel (i.e., the toroid at the start or end of a plurality of toroids), the neck angle is the angle defined by assuming that the inlet or outlet channel is the neck for that toroid.

In one embodiment, the neck angle is about the same for each toroid of the device. In another embodiment, there are a plurality of neck angles, such that not every toroid has the same neck angle.

In one embodiment, the neck angle is from 0 to 180 degrees. In another embodiment, the neck angle is from 90 to 180 degrees. In another embodiment, the neck angle is from 90 to 150 degrees. In another embodiment, the neck angle is from 100 to 140 degrees. In another embodiment, the neck angle is from 110 to 130 degrees. In another embodiment, the neck angle is about 120 degrees.

With reference to FIG. 6, neck length is defined as the distance between the points on adjacent toroids where the direction of the curve changes.

In one embodiment, the neck length is at least twice the radius of curvature of the end mill used to fabricate the mixer. In one embodiment, the neck is at least 0.05 mm long. In one embodiment, the neck is at least 1 mm long. In one embodiment, the neck is at least 0.2 mm long. In one embodiment, the neck is at least 0.25 mm long. In one embodiment, the neck is at least 0.3 mm long. In one embodiment, the neck is from 0.05 mm to 2 mm long. In one embodiment, the neck is from 0.2 mm to 2 mm long.

With regard to materials used to form the mixers, any materials known or developed in the future that can be used to form fluidic devices can be used. In one embodiment, the mixer comprises a polymer selected from the group consisting of polypropylene, polycarbonate, COC, COP, PDMS, polystyrene, nylon, acrylic, HDPE, LDPE, other polyolefins, and combinations thereof. Non-polymeric materials can also be used to fabricate the mixers, including inorganic glasses such as traditional silica-based glasses, metals, and ceramics.

In certain embodiments, a plurality of mixers are included on the same "chip" (i.e., a single substrate containing multiple mixers). In such embodiments, a DVBM mixer is considered to be a plurality of toroidal mixing elements in series that begin and end with an inlet and outlet channel, respectively. Therefore, a chip with multiple mixers includes an embodiment with multiple DVBM mixers (each comprising a plurality of toroidal mixing elements) arranged in parallel or serial configuration. In another embodiment, the plurality of mixers includes one or more DVBM mixers and one non-DVBM mixer (e.g., a SHM). By combining mixer types, the strengths of each type of mixer can be utilized in a single device.

Methods of Use

In another aspect, methods of using the mixers disclosed herein are provided. In one embodiment, the method includes mixing a first liquid with a second liquid by flowing (e.g., impelling or urging) a first liquid and a second liquid through a mixer as disclosed herein (i.e., a DVBM) to produce a mixed solution. Such methods are described in detail elsewhere herein in the context of defining the DVBM devices and their performance. The disclosed mixers can be used for any mixing application known to those of skill in the art where two or more streams of liquids are mixed at relatively low volumes (e.g., microfluidic-level).

In one embodiment, the mixer is incorporated into a larger device that includes a plurality of mixers (that include DVBM), and the method further comprises flowing the first liquid and the second liquid through the plurality of mixers to form the mixed solution. This embodiment relates to parallelization of the mixers to produce higher mixing volumes on a single device. Such parallelization is discussed in the patent documents incorporated by reference.

In one embodiment, the first liquid comprises a first solvent. In one embodiment, the first solvent is an aqueous solution. In one embodiment the aqueous solution is a buffer of defined pH.

In one embodiment, the first liquid comprises one or more macromolecules in a first solvent.

In one embodiment the macromolecule is a nucleic acid. In another embodiment, the macromolecule is a protein. In a further embodiment the macromolecule is a polypeptide.

In one embodiment, the first liquid comprises one or more low molecular weight compounds in a first solvent.

In one embodiment, the second liquid comprises lipid particle-forming materials in a second solvent.

In one embodiment, the second liquid comprises polymer particle-forming materials in a second solvent.

In one embodiment, the second liquid comprises lipid particle-forming materials and one or more macromolecules in a second solvent.

In one embodiment, the second liquid comprises lipid particle-forming materials and one or more low molecular weight compounds in a second solvent.

In one embodiment, the second liquid comprises polymer particle-forming materials and one or more macromolecules in a second solvent.

In one embodiment, the second liquid comprises polymer particle-forming materials and one or more low molecular weight compounds in a second solvent.

In one embodiment, the mixed solution includes particles produced by mixing the first liquid and the second liquid. In one embodiment, the particles are selected from the group consisting of lipid nanoparticles and polymer nanoparticles.

Methods of Manufacture

In another aspect, methods of manufacturing the mixers are provided. In one embodiment, a method is provided that includes forming a master mold using an endmill, wherein the master mold is configured to form DVBM mixers according to the embodiments disclosed herein. While in certain embodiments an endmill is used to fabricate the master, in other embodiments the master is formed using techniques including lithography or electroforming. In such embodiments, R is the minimum feature size that particular technique allows.

In the case where the device is produced using injection molding and the injection molding insert is produced by milling, the inner radius (R) of the toroidal mixing element is greater than or equal to the radius of the endmill used to produce the mold to form the mixer. For mass production, whether it is carried out by embossing, casting, molding or any other replication technique, a master (e.g., a mold) needs to be fabricated. Such a master is most easily fabricated using a precision mill. During milling, a high speed, spinning cutting tool known as an endmill is passed a piece of solid material (such as a steel plate) to remove certain sections and form the desired features. The radius of the endmill therefore defines the minimum radius of any feature to be formed. Masters may also be produced by other techniques, such as lithography, electroforming or others, in which case the resolution of the chosen technique will define the minimum inner radius of the toroid. In one embodiment, the inner radius of the mixer is from 0.1 mm to 2 mm. In one embodiment, the inner radius of the mixer is from 0.1 mm to 1 mm.

Definitions

Microfluidic

As used herein, the term "microfluidic" refers to a system or device for manipulating (e.g., flowing, mixing, etc.) a fluid sample including at least one channel having micron-scale dimensions (i.e., a dimension less than 1 mm).

Therapeutic Material

As used herein, the term "therapeutic material" is defined as a substance intended to furnish pharmacological activity or to otherwise have direct effect in the diagnosis, cure, mitigation, understanding, treatment or prevention of disease, or to have direct effect in restoring, correcting or modifying physiological functions. Therapeutic material includes but is not limited to small molecule drugs, nucleic acids, proteins, peptides, polysaccharides, inorganic ions and radionuclides.

Nanoparticles

As used herein, the term "nanoparticles" is defined as a homogeneous particle comprising more than one component material (for instance lipid, polymer etc.) that is used to encapsulate a therapeutic material and possesses a smallest dimension that is less than 250 nanometers. Nanoparticles include, but are not limited to, lipid nanoparticles and polymer nanoparticles. In one embodiment, the devices are configured to form lipid nanoparticles. In one embodiment, the devices are configured to form polymer nanoparticles. In one embodiment, methods are provided for forming lipid nanoparticles. In one embodiment, methods are provided for forming polymer nanoparticles.

Lipid Nanoparticles

In one embodiment, lipid nanoparticles comprise:

(a) a core; and (b) a shell surrounding the core, wherein the shell comprises a phospholipid.

In one embodiment, the core comprises a lipid (e.g., a fatty acid triglyceride) and is solid. In another embodiment, the core is liquid (e.g., aqueous) and the particle is a vesicle, such as a liposomes. In one embodiment, the shell surrounding the core is a monolayer.

As noted above, in one embodiment, the lipid core comprises a fatty acid triglyceride. Suitable fatty acid triglycerides include C8-C20 fatty acid triglycerides. In one embodiment, the fatty acid triglyceride is an oleic acid triglyceride.

The lipid nanoparticle includes a shell comprising a phospholipid that surrounds the core. Suitable phospholipids include diacylphosphatidylcholines, diacylphosphatidylethanolamines, ceramides, sphingomyelins, dihydrosphingomyelins, cephalins, and cerebrosides. In one embodiment, the phospholipid is a C8-C20 fatty acid diacylphosphatidylcholine. A representative phospholipid is 1-palmitoyl-2-oleoyl phosphatidylcholine (POPC).

In certain embodiments, the ratio of phospholipid to fatty acid triglyceride is from 20:80 (mol:mol) to 60:40 (mol:mol). Preferably, the triglyceride is present in a ratio greater than 40% and less than 80%.

In certain embodiments, the nanoparticle further comprises a sterol. Representative sterols include cholesterol. In one embodiment, the ratio of phospholipid to cholesterol is 55:45 (mol:mol). In representative embodiments, the nanoparticle includes from 55-100% POPC and up to 10 mol % PEG-lipid.

In other embodiments, the lipid nanoparticles of the disclosure may include one or more other lipids including phosphoglycerides, representative examples of which include phosphatidylcholine, phosphatidylethanolamine, phosphatidylserine, phosphatidylinositol, phosphatidic acid, palmitoyloleoylphosphatidylcholine, lyosphosphatidylcholine, lysophosphatidylethanolamine, dipalmitoylphosphatidylcholine, dioleoylphosphatidylcholine, distearoylphosphatidylcholine, and dilinoleoylphosphatidylcholine. Other compounds lacking in phosphorus, such as sphingolipid and glycosphingolipid families are useful. Triacylglycerols are also useful.

Representative nanoparticles of the disclosure have a diameter from about 10 to about 100 nm. The lower diameter limit is from about 10 to about 15 nm.

The limit size lipid nanoparticles of the disclosure can include one or more low molecular weight compounds that are used as therapeutic and/or diagnostic agents. These agents are typically contained within the particle core. The nanoparticles of the disclosure can include a wide variety of therapeutic and/or diagnostic agents.

Suitable low molecular weight compounds agents include chemotherapeutic agents (i.e., anti-neoplastic agents), anesthetic agents, beta-adrenaergic blockers, anti-hypertensive agents, anti-depressant agents, anti-convulsant agents, anti-emetic agents, antihistamine agents, anti-arrhythmic agents, and anti-malarial agents.

Representative antineoplastic agents include doxorubicin, daunorubicin, mitomycin, bleomycin, streptozocin, vinblastine, vincristine, mechlorethamine, hydrochloride, melphalan, cyclophosphamide, triethylenethiophosphoramide, carmaustine, lomustine, semustine, fluorouracil, hydroxyurea, thioguanine, cytarabine, floxuridine, decarbazine, cisplatin, procarbazine, vinorelbine, ciprofloxacion, norfloxacin, paclitaxel, docetaxel, etoposide, bexarotene, teniposide, tretinoin, isotretinoin, sirolimus, fulvestrant, valrubicin, vindesine, leucovorin, irinotecan, capecitabine, gemcitabine, mitoxantrone hydrochloride, oxaliplatin, adriamycin, methotrexate, carboplatin, estramustine, and pharmaceutically acceptable salts and thereof.

In another embodiment, lipid nanoparticles, are nucleic-acid lipid nanoparticles.

The term "nucleic acid-lipid nanoparticles" refers to lipid nanoparticles containing a nucleic acid. The lipid nanoparticles include one or more cationic lipids, one or more second lipids, and one or more nucleic acids.

Cationic lipid. The lipid nanoparticles include a cationic lipid. As used herein, the term "cationic lipid" refers to a lipid that is cationic or becomes cationic (protonated) as the pH is lowered below the pK of the ionizable group of the lipid, but is progressively more neutral at higher pH values. At pH values below the pK, the lipid is then able to associate with negatively charged nucleic acids (e.g., oligonucleotides). As used herein, the term "cationic lipid" includes zwitterionic lipids that assume a positive charge on pH decrease.

The term "cationic lipid" refers to any of a number of lipid species which carry a net positive charge at a selective pH, such as physiological pH. Such lipids include, but are not limited to, N,N-dioleyl-N,N-dimethylammonium chloride (DODAC); N-(2,3-dioleyloxy)propyl)-N,N,N-trimethylammonium chloride (DOTMA); N,N-distearyl-N,N-dimethylammonium bromide (DDAB); N-(2,3-dioleoyloxy)propyl)-N,N,N-trimethylammonium chloride (DOTAP); 3-(N—(N',N'-dimethylaminoethane)-carbamoyl)cholesterol (DC-Chol) and N-(1,2-dimyristyloxyprop-3-yl)-N,N-dimethyl-N-hydroxyethyl ammonium bromide (DMRIE).

Additionally, a number of commercial preparations of cationic lipids are available which can be used in the present disclosure. These include, for example, LIPOFECTIN® (commercially available cationic liposomes comprising DOTMA and 1,2-dioleoyl-sn-3-phosphoethanolamine (DOPE), from GIBCO/BRL, Grand Island, N.Y.); LIPOFECTAMINE® (commercially available cationic liposomes comprising N-(1-(2,3-dioleyloxy)propyl)-N-(2-(sperminecarboxamido)ethyl)-N,N-dimethylammonium trifluoroacetate (DOSPA) and (DOPE), from GIBCO/BRL); and TRANSFECTAM® (commercially available cationic lipids comprising dioctadecylamidoglycyl carboxyspermine (DOGS) in ethanol from Promega Corp., Madison, Wis.). The following lipids are cationic and have a positive charge at below physiological pH: DODAP, DODMA, DMDMA, 1,2-dilinoleyloxy-N,N-dimethylaminopropane (DLinDMA), 1,2-dilinolenyloxy-N,N-dimethylaminopropane (DLenDMA).

In one embodiment, the cationic lipid is an amino lipid. Suitable amino lipids useful in the disclosure include those described in WO 2009/096558, incorporated herein by reference in its entirety. Representative amino lipids include 1,2-dilinoleyoxy-3-(dimethylamino)acetoxypropane (DLin-DAC), 1,2-dilinoleyoxy-3-morpholinopropane (DLin-MA), 1,2-dilinoleoyl-3-dimethylaminopropane (DLinDAP), 1,2-dilinoleylthio-3-dimethylaminopropane (DLin-S-DMA), 1-linoleoyl-2-linoleyloxy-3-dimethylaminopropane (DLin-2-DMAP), 1,2-dilinoleyloxy-3-trimethylaminopropane chloride salt (DLin-TMA.Cl), 1,2-dilinoleoyl-3-trimethylaminopropane chloride salt (DLin-TAP.Cl), 1,2-dilinoleyloxy-3-(N-methylpiperazino)propane (DLin-MPZ), 3-(N,N-dilinoleylamino)-1,2-propanediol (DLinAP), 3-(N,N-dioleylamino)-1,2-propanedio (DOAP), 1,2-dilinoleyloxo-3-(2-N,N-dimethylamino)ethoxypropane (DLin-EG-DMA), and 2,2-dilinoleyl-4-dimethylaminomethyl[1,3]-dioxolane (DLin-K-DMA).

Suitable amino lipids include those having the formula:

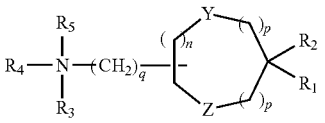

wherein $R_1$ and $R_2$ are either the same or different and independently optionally substituted $C_{10}$-$C_{24}$ alkyl, optionally substituted $C_{10}$-$C_{24}$ alkenyl, optionally substituted $C_{10}$-$C_{24}$ alkynyl, or optionally substituted $C_{10}$-$C_{24}$ acyl;

$R_3$ and $R_4$ are either the same or different and independently optionally substituted $C_1$-$C_6$ alkyl, optionally substituted $C_2$-$C_6$ alkenyl, or optionally substituted $C_2$-$C_6$ alkynyl or $R_3$ and $R_4$ may join to form an optionally substituted heterocyclic ring of 4 to 6 carbon atoms and 1 or 2 heteroatoms chosen from nitrogen and oxygen;

$R_5$ is either absent or present and when present is hydrogen or $C_1$-$C_6$ alkyl;

m, n, and p are either the same or different and independently either 0 or 1 with the proviso that m, n, and p are not simultaneously 0;

q is 0, 1, 2, 3, or 4; and

Y and Z are either the same or different and independently O, S, or NH.

In one embodiment, $R_1$ and $R_2$ are each linoleyl, and the amino lipid is a dilinoleyl amino lipid. In one embodiment, the amino lipid is a dilinoleyl amino lipid.

A representative useful dilinoleyl amino lipid has the formula:

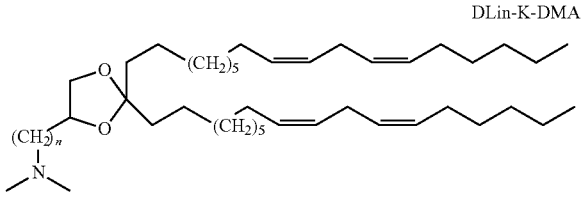

wherein n is 0, 1, 2, 3, or 4.

In one embodiment, the cationic lipid is a DLin-K-DMA. In one embodiment, the cationic lipid is DLin-KC2-DMA (DLin-K-DMA above, wherein n is 2).

Other suitable cationic lipids include cationic lipids, which carry a net positive charge at about physiological pH, in addition to those specifically described above, N,N-dioleyl-N,N-dimethylammonium chloride (DODAC); N-(2,3-dioleyloxy)propyl-N,N—N-triethylammonium chloride (DOTMA); N,N-distearyl-N,N-dimethylammonium bromide (DDAB); N-(2,3-dioleoyloxy)propyl)-N,N,N-trimethylammonium chloride (DOTAP); 1,2-dioleyloxy-3-trimethylaminopropane chloride salt (DOTAP.Cl); 3β-(N—(N',N'-dimethylaminoethane)carbamoyl)cholesterol (DC-Chol), N-(1-(2,3-dioleoyloxy)propyl)-N-2-(sperminecarboxamido)ethyl)-N,N-dimethylammonium trifluoracetate (DOSPA), dioctadecylamidoglycyl carboxyspermine (DOGS), 1,2-dioleoyl-3-dimethylammonium propane (DODAP), N,N-dimethyl-2,3-dioleoyloxy)propylamine (DODMA), and N-(1,2-dimyristyloxyprop-3-yl)-N,N-dimethyl-N-hydroxyethyl ammonium bromide (DMRIE). Additionally, a number of commercial preparations of cationic lipids can be used, such as, e.g., LIPOFECTIN (including DOTMA and DOPE, available from GIBCO/BRL), and LIPOFECTAMINE (comprising DOSPA and DOPE, available from GIBCO/BRL).

The cationic lipid is present in the lipid particle in an amount from about 30 to about 95 mole percent. In one embodiment, the cationic lipid is present in the lipid particle in an amount from about 30 to about 70 mole percent. In one embodiment, the cationic lipid is present in the lipid particle in an amount from about 40 to about 60 mole percent.

In one embodiment, the lipid particle includes ("consists of") only of one or more cationic lipids and one or more nucleic acids.

Second lipids. In certain embodiments, the lipid nanoparticles include one or more second lipids. Suitable second lipids stabilize the formation of nanoparticles during their formation.

The term "lipid" refers to a group of organic compounds that are esters of fatty acids and are characterized by being insoluble in water but soluble in many organic solvents. Lipids are usually divided in at least three classes: (1) "simple lipids" which include fats and oils as well as waxes; (2) "compound lipids" which include phospholipids and glycolipids; and (3) "derived lipids" such as steroids.

Suitable stabilizing lipids include neutral lipids and anionic lipids.

Neutral Lipid. The term "neutral lipid" refers to any one of a number of lipid species that exist in either an uncharged or neutral zwitterionic form at physiological pH. Representative neutral lipids include diacylphosphatidylcholines, diacylphosphatidylethanolamines, ceramides, sphingomyelins, dihydrosphingomyelins, cephalins, and cerebrosides.

Exemplary lipids include, for example, distearoylphosphatidylcholine (DSPC), dioleoylphosphatidylcholine (DOPC), dipalmitoylphosphatidylcholine (DPPC), dioleoylphosphatidylglycerol (DOPG), dipalmitoylphosphatidylglycerol (DPPG), dioleoyl-phosphatidylethanolamine (DOPE), palmitoyloleoylphosphatidylcholine (POPC), palmitoyloleoyl-phosphatidylethanolamine (POPE) and dioleoyl-phosphatidylethanolamine 4-(N-maleimidomethyl)-cyclohexane-1-carboxylate (DOPE-mal), dipalmitoyl phosphatidyl ethanolamine (DPPE), dimyristoylphosphoethanolamine (DMPE), distearoyl-phosphatidylethanolamine (DSPE), 16-O-monomethyl PE, 16-O-dimethyl PE, 18-1-trans PE, 1-stearoyl-2-oleoyl-phosphatidyethanolamine (SOPE), and 1,2-dielaidoyl-sn-glycero-3-phosphoethanolamine (transDOPE).

In one embodiment, the neutral lipid is 1,2-distearoyl-sn-glycero-3-phosphocholine (DSPC).

Anionic Lipid. The term "anionic lipid" refers to any lipid that is negatively charged at physiological pH. These lipids include phosphatidylglycerol, cardiolipin, diacylphosphatidylserine, diacylphosphatidic acid, N-dodecanoylphosphatidylethanol-amines, N-succinylphosphatidylethanolamines, N-glutarylphosphatidylethanolamines, lysylphosphatidylglycerols, palmitoyloleyolphosphatidylglycerol (POPG), and other anionic modifying groups joined to neutral lipids.

Other suitable lipids include glycolipids (e.g., monosialoganglioside $GM_1$). Other suitable second lipids include sterols, such as cholesterol.

Polyethylene glycol-lipids. In certain embodiments, the second lipid is a polyethylene glycol-lipid. Suitable polyethylene glycol-lipids include PEG-modified phosphatidylethanolamine, PEG-modified phosphatidic acid, PEG-modified ceramides (e.g., PEG-CerC14 or PEG-CerC20), PEG-modified dialkylamines, PEG-modified diacylglycerols, PEG-modified dialkylglycerols. Representative polyethylene glycol-lipids include PEG-c-DOMG, PEG-c-DMA, and PEG-s-DMG. In one embodiment, the polyethylene glycol-lipid is N-[(methoxy poly(ethylene glycol)$_{2000}$)carbamyl]-1,2-dimyristyloxlpropyl-3-amine (PEG-c-DMA). In one embodiment, the polyethylene glycol-lipid is PEG-c-DOMG).

In certain embodiments, the second lipid is present in the lipid particle in an amount from about 0.5 to about 10 mole percent. In one embodiment, the second lipid is present in the lipid particle in an amount from about 1 to about 5 mole percent. In one embodiment, the second lipid is present in the lipid particle in about 1 mole percent.

Nucleic Acids. The lipid nanoparticles of the present disclosure are useful for the systemic or local delivery of nucleic acids. As described herein, the nucleic acid is incorporated into the lipid particle during its formation.

As used herein, the term "nucleic acid" is meant to include any oligonucleotide or polynucleotide. Fragments containing up to 50 nucleotides are generally termed oligonucleotides, and longer fragments are called polynucleotides. In particular embodiments, oligonucleotides of the present disclosure are 20-50 nucleotides in length. In the context of this disclosure, the terms "polynucleotide" and "oligonucleotide" refer to a polymer or oligomer of nucleotide or nucleoside monomers consisting of naturally occurring bases, sugars and intersugar (backbone) linkages. The terms "polynucleotide" and "oligonucleotide" also includes polymers or oligomers comprising non-naturally occurring monomers, or portions thereof, which function similarly. Such modified or substituted oligonucleotides are often preferred over native forms because of properties such as, for example, enhanced cellular uptake and increased stability in the presence of nucleases. Oligonucleotides are classified as deoxyribooligonucleotides or ribooligonucleotides. A deoxyribooligonucleotide consists of a 5-carbon sugar called deoxyhbose joined covalently to phosphate at the 5' and 3' carbons of this sugar to form an alternating, unbranched polymer. A ribooligonucleotide consists of a similar repeating structure where the 5-carbon sugar is ribose. The nucleic acid that is present in a lipid particle according to this disclosure includes any form of nucleic acid that is known. The nucleic acids used herein can be single-stranded DNA or RNA, or double-stranded DNA or RNA, or DNA-RNA hybrids. Examples of double-stranded DNA include structural genes, genes including control and termination regions, and self-replicating systems such as viral or plasmid DNA. Examples of double-stranded RNA include siRNA and other RNA interference reagents. Single-stranded nucleic acids include antisense oligonucleotides, ribozymes, microRNA, mRNA, and triplex-forming oligonucleotides.

In one embodiment, the polynucleic acid is an antisense oligonucleotide. In certain embodiments, the nucleic acid is an antisense nucleic acid, a ribozyme, tRNA, snRNA, snoRNA, siRNA, shRNA, saRNA, tRNA, rRNA, piRNA, ncRNA, miRNA, mRNA, lncRNA, sgRNA, tracrRNA, precondensed DNA, ASO, or an aptamer.

The term "nucleic acids" also refers to ribonucleotides, deoxynucleotides, modified ribonucleotides, modified deoxyribonucleotides, modified phosphate-sugar-backbone oligonucleotides, other nucleotides, nucleotide analogs, and combinations thereof, and can be single stranded, double stranded, or contain portions of both double stranded and single stranded sequence, as appropriate.

The term "nucleotide", as used herein, generically encompasses the following terms, which are defined below: nucleotide base, nucleoside, nucleotide analog, and universal nucleotide.

The term "nucleotide base", as used herein, refers to a substituted or unsubstituted parent aromatic ring or rings. In some embodiments, the aromatic ring or rings contain at least one nitrogen atom. In some embodiments, the nucleotide base is capable of forming Watson-Crick and/or Hoogsteen hydrogen bonds with an appropriately complementary nucleotide base. Exemplary nucleotide bases and analogs thereof include, but are not limited to, purines such as 2-aminopurine, 2,6-diaminopurine, adenine (A), ethenoadenine, N6-2-isopentenyladenine (6iA), N6-2-isopentenyl-2-methylthioadenine (2ms6iA), N6-methyladenine, guanine (G), isoguanine, N2-dimethylguanine (dmG), 7-methylguanine (7mG), 2-thiopyrimidine, 6-thioguanine (6sG) hypoxanthine and O6-methylguanine; 7-deaza-purines such as 7-deazaadenine (7-deaza-A) and 7-deazaguanine (7-deaza-G); pyrimidines such as cytosine (C), 5-propynylcytosine, isocytosine, thymine (T), 4-thiothymine (4sT), 5,6-dihydrothymine, O4-methylthymine, uracil (U), 4-thiouracil (4sU) and 5,6-dihydrouracil (dihydrouracil; D); indoles such as nitroindole and 4-methylindole; pyrroles such as nitropyrrole; nebularine; base (Y); In some embodiments, nucleotide bases are universal nucleotide bases. Additional exemplary nucleotide bases can be found in Fasman, 1989, Practical Handbook of Biochemistry and Molecular Biology, pp. 385-394, CRC Press, Boca Raton, Fla., and the references cited therein. Further examples of universal bases can be found for example in Loakes, N. A. R. 2001, vol 29:2437-2447 and Seela N. A. R. 2000, vol 28:3224-3232.

The term "nucleoside", as used herein, refers to a compound having a nucleotide base covalently linked to the C-1' carbon of a pentose sugar. In some embodiments, the linkage is via a heteroaromatic ring nitrogen. Typical pentose sugars include, but are not limited to, those pentoses in which one or more of the carbon atoms are each independently substituted with one or more of the same or different —R, —OR, —NRR or halogen groups, where each R is independently hydrogen, (C1-C6) alkyl or (C5-C14) aryl. The pentose sugar may be saturated or unsaturated. Exemplary pentose sugars and analogs thereof include, but are not limited to, ribose, 2'-deoxyribose, 2'-(C1-C6)alkoxyribose, 2'-(C5-C14)aryloxyribose, 2',3'-dideoxyribose, 2',3'-didehydroribose, 2'-deoxy-3'-haloribose, 2'-deoxy-3'-fluororibose, 2'-deoxy-3'-chlororibose, 2'-deoxy-3'-aminoribose, 2'-deoxy-3'-(C1-C6)alkylribose, 2'-deoxy-3'-(C1-C6)alkoxyribose and 2'-deoxy-3'-(C5-C14)aryloxyribose. Also see, e.g., 2'-O-methyl, 4'-.alpha.-anomeric nucleotides, 1'-.alpha.-anomeric nucleotides (Asseline (1991) Nucl. Acids Res. 19:4067-74), 2'-4'- and 3'-4'-linked and other "locked" or "LNA", bicyclic sugar modifications (WO 98/22489; WO 98/39352; WO 99/14226). "LNA" or "locked nucleic acid" is a DNA analogue that is conformationally locked such that the ribose ring is constrained by a methylene linkage between the 2'-oxygen and the 3'- or 4'-carbon. The conformation restriction imposed by the linkage often increases binding affinity for complementary sequences and increases the thermal stability of such duplexes.

Sugars include modifications at the 2'- or 3'-position such as methoxy, ethoxy, allyloxy, isopropoxy, butoxy, isobutoxy, methoxyethyl, alkoxy, phenoxy, azido, amino, alkylamino, fluoro, chloro and bromo. Nucleosides and nucleotides include the natural D configurational isomer (D-form), as well as the L configurational isomer (L-form) (Beigelman, U.S. Pat. No. 6,251,666; Chu, U.S. Pat. No. 5,753,789; Shudo, EP0540742; Garbesi (1993) Nucl. Acids Res. 21:4159-65; Fujimori (1990) J. Amer. Chem. Soc. 112:7435; Urata, (1993) Nucleic Acids Symposium Ser. No. 29:69-70). When the nucleobase is purine, e.g., A or G, the ribose sugar is attached to the N9-position of the nucleobase. When the nucleobase is pyrimidine, e.g., C, T or U, the pentose sugar is attached to the N1-position of the nucleobase (Kornberg and Baker, (1992) DNA Replication, 2$^{nd}$ Ed., Freeman, San Francisco, Calif.).

One or more of the pentose carbons of a nucleoside may be substituted with a phosphate ester. In some embodiments, the phosphate ester is attached to the 3'- or 5'-carbon of the pentose. In some embodiments, the nucleosides are those in which the nucleotide base is a purine, a 7-deazapurine, a pyrimidine, a universal nucleotide base, a specific nucleotide base, or an analog thereof.

The term "nucleotide analog", as used herein, refers to embodiments in which the pentose sugar and/or the nucleotide base and/or one or more of the phosphate esters of a nucleoside may be replaced with its respective analog. In some embodiments, exemplary pentose sugar analogs are those described above. In some embodiments, the nucleotide analogs have a nucleotide base analog as described above. In some embodiments, exemplary phosphate ester analogs include, but are not limited to, alkylphosphonates, methylphosphonates, phosphoramidates, phosphotriesters, phosphorothioates, phosphorodithioates, phosphoroselenoates, phosphorodiselenoates, phosphoroanilothioates, phosphoroanilidates, phosphoroamidates, boronophosphates, and may include associated counterions. Other nucleic acid analogs and bases include for example intercalating nucleic acids (INAs, as described in Christensen and Pedersen, 2002), and AEGIS bases (Eragen, U.S. Pat. No. 5,432,272). Additional descriptions of various nucleic acid analogs can also be found for example in (Beaucage et al., Tetrahedron 49(10):1925 (1993) and references therein; Letsinger, J. Org. Chem. 35:3800 (1970); Sprinzl et al., Eur. J. Biochem. 81:579 (1977); Letsinger et al., Nucl. Acids Res. 14:3487 (1986); Sawai et al, Chem. Lett. 805 (1984), Letsinger et al., J. Am. Chem. Soc. 110:4470 (1988); and Pauwels et al., Chemica Scripta 26:141 91986)), phosphorothioate (Mag et al., Nucleic Acids Res. 19:1437 (1991); and U.S. Pat. No. 5,644,048. Other nucleic analogs comprise phosphorodithioates (Briu et al., J. Am. Chem. Soc. 111:2321 (1989), O-methylphophoroamidite linkages (see Eckstein, Oligonucleotides and Analogues: A Practical Approach, Oxford University Press), those with positive backbones (Denpcy et al., Proc. Natl. Acad. Sci. USA 92:6097 (1995); non-ionic backbones (U.S. Pat. Nos. 5,386,023, 5,386,023, 5,637,684, 5,602,240, 5,216,141, and 4,469,863. Kiedrowshi et al., Angew. Chem. Intl. Ed. English 30:423 (1991); Letsinger et al., J. Am. Chem. Soc. 110:4470 (1988); Letsinger et al., Nucleoside & Nucleotide 13:1597 (194): Chapters 2 and 3, ASC Symposium Series 580, "Carbohydrate Modifications in Antisense Research", Ed. Y. S. Sanghui and P. Dan Cook; Mesmaeker et al., Bioorganic & Medicinal Chem. Lett. 4:395 (1994); Jeffs et al., J. Biomolecular NMR 34:17 (1994); Tetrahedron Lett. 37:743 (1996)) and non-ribose backbones, including those described in U.S. Pat. Nos. 5,235,033 and 5,034,506, and Chapters 6 and 7, ASC Symposium Series 580, "Carbohydrate Modifications in Antisense Research", Ed. Y. S. Sanghui and P. Dan Cook. Nucleic acids containing one or more carbocyclic sugars are also included within the definition of nucleic acids (see Jenkins et al., Chem. Soc. Rev. (1995) pp 169-176). Several nucleic acid analogs are also described in Rawls, C & E News Jun. 2, 1997 page 35.

The term "universal nucleotide base" or "universal base", as used herein, refers to an aromatic ring moiety, which may or may not contain nitrogen atoms. In some embodiments, a universal base may be covalently attached to the C-1' carbon of a pentose sugar to make a universal nucleotide. In some embodiments, a universal nucleotide base does not hydrogen bond specifically with another nucleotide base. In some embodiments, a universal nucleotide base hydrogen bonds with nucleotide base, up to and including all nucleotide bases in a particular target polynucleotide. In some embodiments, a nucleotide base may interact with adjacent nucleotide bases on the same nucleic acid strand by hydrophobic stacking. Universal nucleotides include, but are not limited to, deoxy-7-azaindole triphosphate (d7AITP), deoxyisocarbostyril triphosphate (dICSTP), deoxypropynylisocarbostyril triphosphate (dPICSTP), deoxymethyl-7-azaindole triphosphate (dM7AITP), deoxyImPy triphosphate (dImPyTP), deoxyPP triphosphate (dPPTP), or deoxypropynyl-7-azaindole triphosphate (dP7AITP). Further examples of such universal bases can be found, inter alia, in Published U.S. application Ser. No. 10/290,672, and U.S. Pat. No. 6,433,134.

As used herein, the terms "polynucleotide" and "oligonucleotide" are used interchangeably and mean single-stranded and double-stranded polymers of nucleotide monomers, including 2'-deoxyribonucleotides (DNA) and ribonucleotides (RNA) linked by internucleotide phosphodiester bond linkages, e.g., 3'-5' and 2'-5', inverted linkages, e.g., 3'-3' and 5'-5', branched structures, or internucleotide analogs. Polynucleotides have associated counter ions, such as H+, NH4+, trialkylammonium, Mg2+, Na+, and the like. A polynucleotide may be composed entirely of deoxyribonucleotides, entirely of ribonucleotides, or chimeric mixtures thereof. Polynucleotides may be comprised of internucleotide, nucleobase and/or sugar analogs.

Polynucleotides typically range in size from a few monomeric units, e.g., 3-40 when they are more commonly frequently referred to in the art as oligonucleotides, to several thousands of monomeric nucleotide units. Unless denoted otherwise, whenever a polynucleotide sequence is represented, it will be understood that the nucleotides are in 5' to 3' order from left to right and that "A" denotes deoxyadenosine, "C" denotes deoxycytosine, "G" denotes deoxyguanosine, and "T" denotes thymidine, unless otherwise noted.

As used herein, "nucleobase" means those naturally occurring and those non-naturally occurring heterocyclic moieties commonly known to those who utilize nucleic acid technology or utilize peptide nucleic acid technology to thereby generate polymers that can sequence specifically bind to nucleic acids. Non-limiting examples of suitable nucleobases include: adenine, cytosine, guanine, thymine, uracil, 5-propynyl-uracil, 2-thio-5-propynyl-uracil, 5-methylcytosine, pseudoisocytosine, 2-thiouracil and 2-thiothymine, 2-aminopurine, N9-(2-amino-6-chloropurine), N9-(2,6-diaminopurine), hypoxanthine, N9-(7-deaza-guanine), N9-(7-deaza-8-aza-guanine) and N8-(7-deaza-8-aza-adenine). Other non-limiting examples of suitable nucleobase include those nucleobases illustrated in FIGS. 2(A) and 2(B) of Buchardt et al. (WO92/20702 or WO92/20703).

As used herein, "nucleobase sequence" means any segment, or aggregate of two or more segments (e.g. the aggregate nucleobase sequence of two or more oligomer blocks), of a polymer that comprises nucleobase-containing subunits. Non-limiting examples of suitable polymers or polymers segments include oligodeoxynucleotides (e.g. DNA), oligoribonucleotides (e.g. RNA), peptide nucleic acids (PNA), PNA chimeras, PNA combination oligomers, nucleic acid analogs and/or nucleic acid mimics.

As used herein, "polynucleobase strand" means a complete single polymer strand comprising nucleobase subunits. For example, a single nucleic acid strand of a double stranded nucleic acid is a polynucleobase strand.

As used herein, "nucleic acid" is a nucleobase sequence-containing polymer, or polymer segment, having a backbone formed from nucleotides, or analogs thereof.

Preferred nucleic acids are DNA and RNA.

As used herein, nucleic acids may also refer to "peptide nucleic acid" or "PNA" means any oligomer or polymer segment (e.g. block oligomer) comprising two or more PNA subunits (residues), but not nucleic acid subunits (or analogs thereof), including, but not limited to, any of the oligomer or polymer segments referred to or claimed as peptide nucleic acids in U.S. Pat. Nos. 5,539,082, 5,527,675, 5,623,049, 5,714,331, 5,718,262, 5,736,336, 5,773,571, 5,766,855, 5,786,461, 5,837,459, 5,891,625, 5,972,610, 5,986,053 and 6,107,470; all of which are herein incorporated by reference. The term "peptide nucleic acid" or "PNA" shall also apply to any oligomer or polymer segment comprising two or more subunits of those nucleic acid mimics described in the following publications: Lagriffoul et al., Bioorganic & Medicinal Chemistry Letters, 4: 1081-1082 (1994); Petersen et al., Bioorganic & Medicinal Chemistry Letters, 6: 793-796 (1996); Diderichsen et al., Tett. Lett. 37: 475-478 (1996); Fujii et al., Bioorg. Med. Chem. Lett. 7: 637-627 (1997); Jordan et al., Bioorg. Med. Chem. Lett. 7: 687-690 (1997); Krotz et al., Tett. Lett. 36: 6941-6944 (1995); Lagriffoul et al., Bioorg. Med. Chem. Lett. 4: 1081-1082 (1994); Diederichsen, U., Bioorganic & Medicinal Chemistry Letters, 7: 1743-1746 (1997); Lowe et al., J. Chem. Soc. Perkin Trans. 1, (1997) 1: 539-546; Lowe et J. Chem. Soc. Perkin Trans. 11: 547-554 (1997); Lowe et al., J. Chem. Soc. Perkin Trans. 11:555-560 (1997); Howarth et al., J. Org. Chem. 62: 5441-5450 (1997); Altmann, K-H et al., Bioorganic & Medicinal Chemistry Letters, 7: 1119-1122 (1997); Diederichsen, U., Bioorganic & Med. Chem. Lett., 8: 165-168 (1998); Diederichsen et al., Angew. Chem. Int. Ed., 37: 302-305 (1998); Cantin et al., Tett. Lett., 38: 4211-4214 (1997); Ciapetti et al., Tetrahedron, 53: 1167-1176 (1997); Lagriffoule et al., Chem. Eur. J., 3: 912-919 (1997); Kumar et al., Organic Letters 3(9): 1269-1272 (2001); and the Peptide-Based Nucleic Acid Mimics (PENAMS) of Shah et al. as disclosed in WO96/04000.

Polymer Nanoparticles

The term "polymer nanoparticles" refers to polymer nanoparticles containing a therapeutic material. Polymer nanoparticles have been developed using, a wide range of materials including, but not limited to: synthetic homopolymers such as polyethylene glycol, polylactide, polyglycolide, poly(lactide-coglycolide), polyacrylates, polymethacrylates, polycaprolactone, polyorthoesters, polyanhydrides, polylysine, polyethyleneimine; synthetic copolymers such as poly (lactide-coglycolide), poly(lactide)-poly(ethylene glycol), poly(lactide-co-glycolide)-poly(ethylene glycol), poly (caprolactone)-poly(ethylene glycol); natural polymers such as cellulose, chitin, and alginate, as well as polymer-therapeutic material conjugates.

As used herein, the term "polymer" refers to compounds of usually high molecular weight built up chiefly or completely from a large number of similar units bonded together. Such polymers include any of numerous natural, synthetic and semi-synthetic polymers.

The term "natural polymer" refers to any number of polymer species derived from nature. Such polymers include, but are not limited to the polysaccharides, cellulose, chitin, and alginate.

The term "synthetic polymer" refers to any number of synthetic polymer species not found in Nature. Such synthetic polymers include, but are not limited to, synthetic homopolymers and synthetic copolymers.

Synthetic homopolymers include, but are not limited to, polyethylene glycol, polylactide, polyglycolide, polyacrylates, polymethacrylates, polycaprolactone, polyorthoesters, polyanhydrides, polylysine, and polyethyleneimine.

"Synthetic copolymer" refers to any number of synthetic polymer species made up of two or more synthetic homopolymer subunits. Such synthetic copolymers include, but are not limited to, poly(lactide-co-glycolide), poly(lactide)-poly (ethylene glycol), poly(lactide-co-glycolide)-poly(ethylene glycol), and poly(caprolactone)-poly(ethylene glycol).

The term "semi-synthetic polymer" refers to any number of polymers derived by the chemical or enzymatic treatment of natural polymers. Such polymers include, but are not limited to, carboxymethyl cellulose, acetylated carboxymethylcellulose, cyclodextrin, chitosan and gelatin.

As used herein, the term "polymer conjugate" refers to a compound prepared by covalently, or non-covalently conjugating one or more molecular species to a polymer. Such polymer conjugates include, but are not limited to, polymer-therapeutic material conjugates.

Polymer-therapeutic material conjugate refers to a polymer conjugate where one or more of the conjugated molecular species is a therapeutic material. Such polymer-therapeutic material conjugates include, but are not limited to, polymer-drug conjugates.

"Polymer-drug conjugate" refers to any number of polymer species conjugated to any number of drug species. Such polymer drug conjugates include, but are not limited to, acetyl methylcellulose-polyethylene glycol-docetaxol.

As used herein, the term "about" indicates that the associated value can be modified, unless otherwise indicated, by plus or minus five percent (+/−5%) and remain within the scope of the embodiments disclosed.

INCORPORATION BY REFERENCE

Compatible microfluidic mixing methods and devices are disclosed in the following reference. The mixers disclosed herein can be incorporated into any of the mixing devices disclosed in these references or can be used to mix any of the compositions disclosed in these references:

(1) U.S. patent application Ser. No. 13/464,690, which is a continuation of PCT/CA2010/001766, filed Nov. 4, 2010, which claims the benefit of U.S. Ser. No. 61/280,510, filed Nov. 4, 2009;

(2) U.S. patent application Ser. No. 14/353,460, which is a continuation of PCT/CA2012/000991, filed Oct. 25, 2012, which claims the benefit of U.S. Ser. No. 61/551,366, filed Oct. 25, 2011;

(3) PCT/US2014/029116, filed Mar. 14, 2014 (published as WO 2014/172045, Oct. 23, 2014), which claims the benefit of U.S. Ser. No. 61/798,495, filed Mar. 15, 2013;

(4) PCT/US2014/041865, filed Jul. 25, 2014 (published as WO 2015/013596, Jan. 29, 2015), which claims the benefit of U.S. Ser. No. 61/858,973, filed Jul. 26, 2013; and (5) PCT/US2014/060961, which claims the benefit of U.S. Ser. No. 61/891,758, filed Oct. 16, 2013;

(6) U.S. Provisional Patent Application No. 62/120,179, filed Feb. 24, 2015; and (7) U.S. Provisional Patent Application No. 62/154,043, filed Apr. 28, 2015, the disclosures of which are hereby incorporated by reference in their entirety.

The following example is included for the purpose of illustrating, not limiting, the described embodiments.

EXAMPLES

Example 1: DVBM Device Testing and Results

Devices with two fluid inlets and one outlet were fabricated for testing. Four different concepts were tested. The four designs are summarized in Table 1 below. In the case of mixers Type 1-3, the impedance imbalance is created by changing the width of the two sides of the toroids (FIG. 3). The DVBM achieves the impedance imbalance by changing the path length through the toroids. All test devices had inlet channel widths of 140 μm and heights of 105 μm (hydrodynamic diameter of 120 um μm; Impedance per length*viscosity is approximately: 6.9*10^−5/um^4).

TABLE 1

Configurations of various microfluidic mixer designs.

Figure 20:
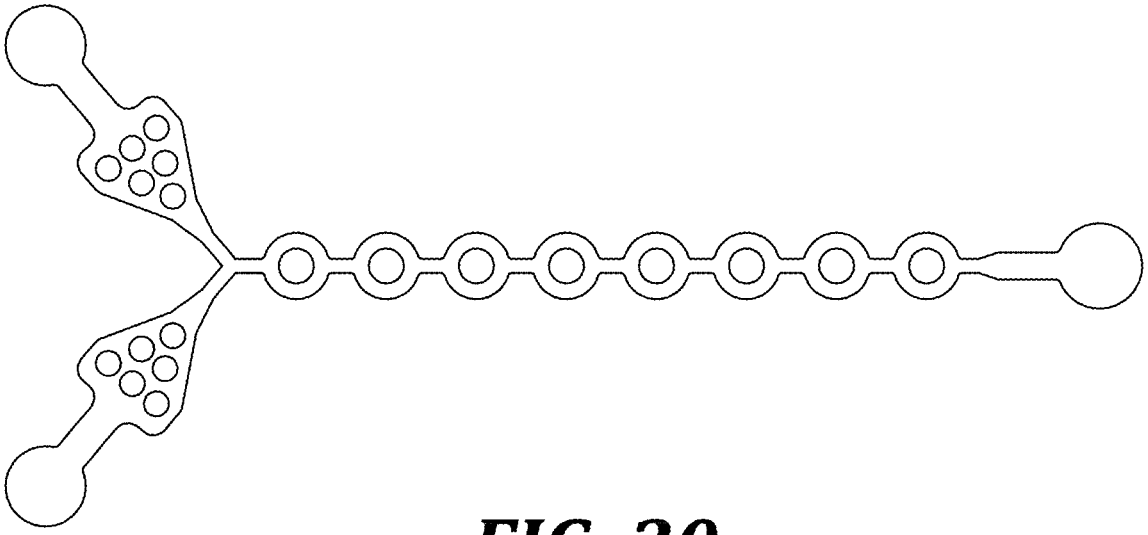
FIG. 20 illustrates the configuration of a comparative ("Type 1") microfluidic mixer.
Figure 21:
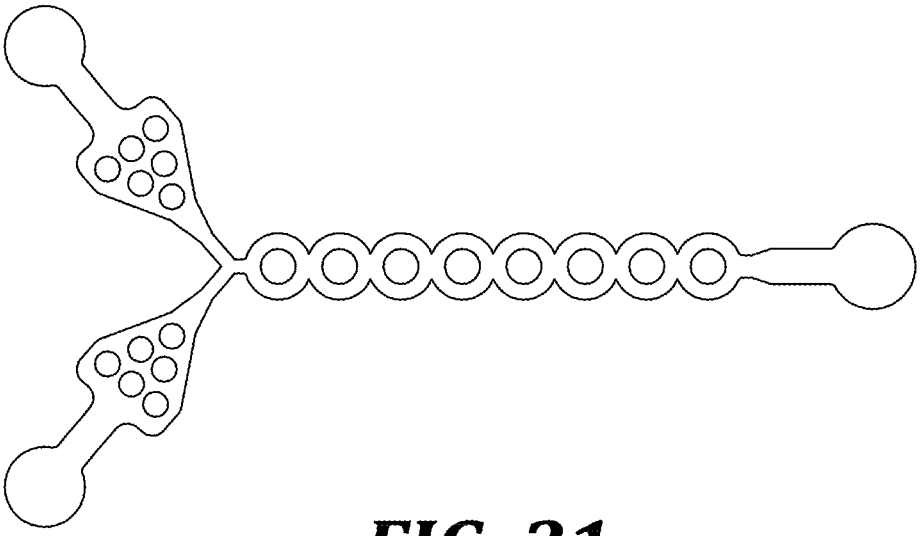
FIG. 21 illustrates the configuration of a comparative ("Type 2") microfluidic mixer.
Figure 22:
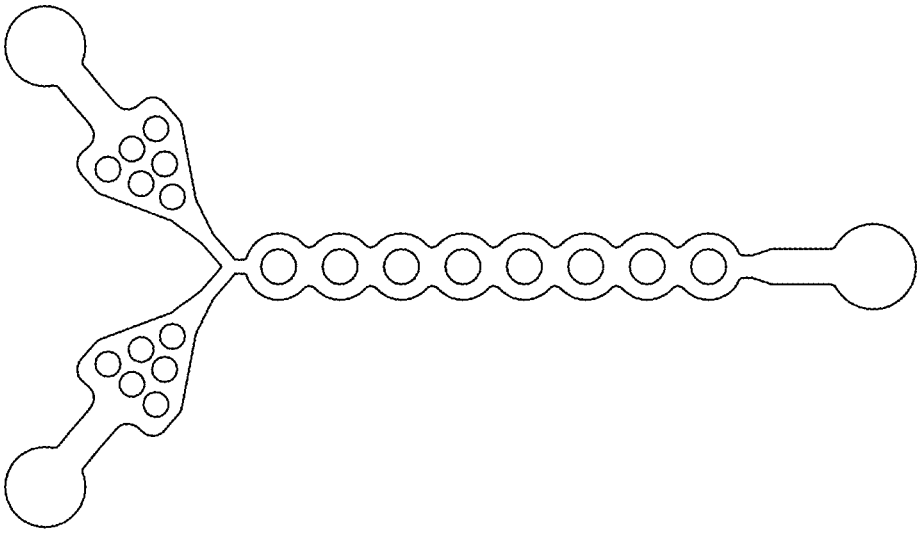
FIG. 22 illustrates the configuration of a comparative ("Type 3") microfluidic mixer.
Figure 23:
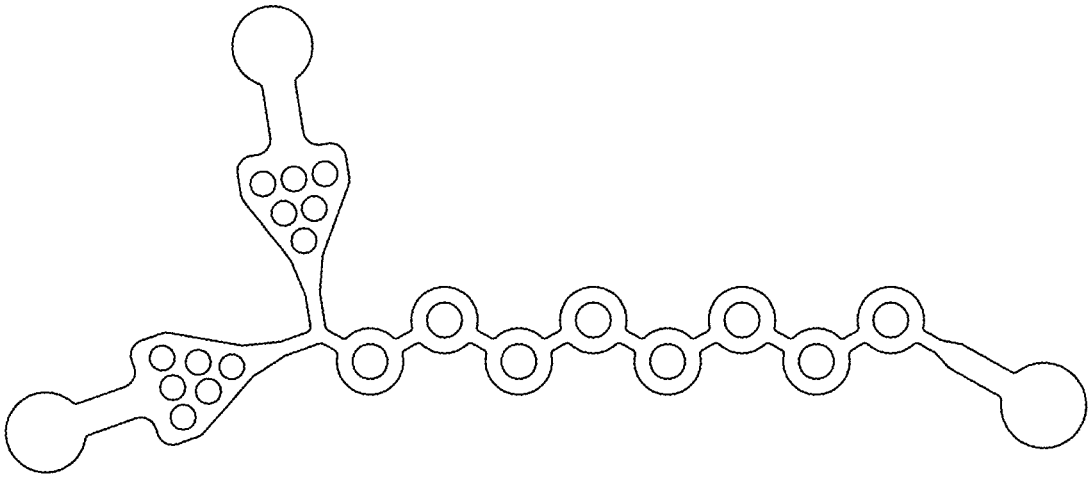
FIG. 23 illustrates the configuration of an exemplary DVBM.

| | | |
|---|---|---|
| Type 1 | Impedance imbalance achieved by differing the width of the channels around the toroid (2:1 ratio)<br>A series of toroids connected by a neck of length L<br>For test devices, L = 310 μm | Illustrated in FIG. 20 |
| Type 2 | Impedance imbalance achieved by differing the width of the channels around the toroid (2:1 ratio)<br>A series of toroids with no neck connecting them (sharp interface) | Illustrated in FIG. 21 |
| Type 3 | Impedance imbalance achieved by differing the width of the channels around the toroid (2:1 ratio)<br>A series of toroids with no neck connecting them (filleted interface, radius R)<br>For test devices, R = 160 μm | Illustrated in FIG. 22 |
| Exemplary DVBM | Impedance imbalance achieved by the differing path length caused by the angled "neck" (2:1 impedance ratio resulting from 2:1 ratio of lengths of legs in each toroid) | Illustrated in FIG. 23 |

Figure 7:
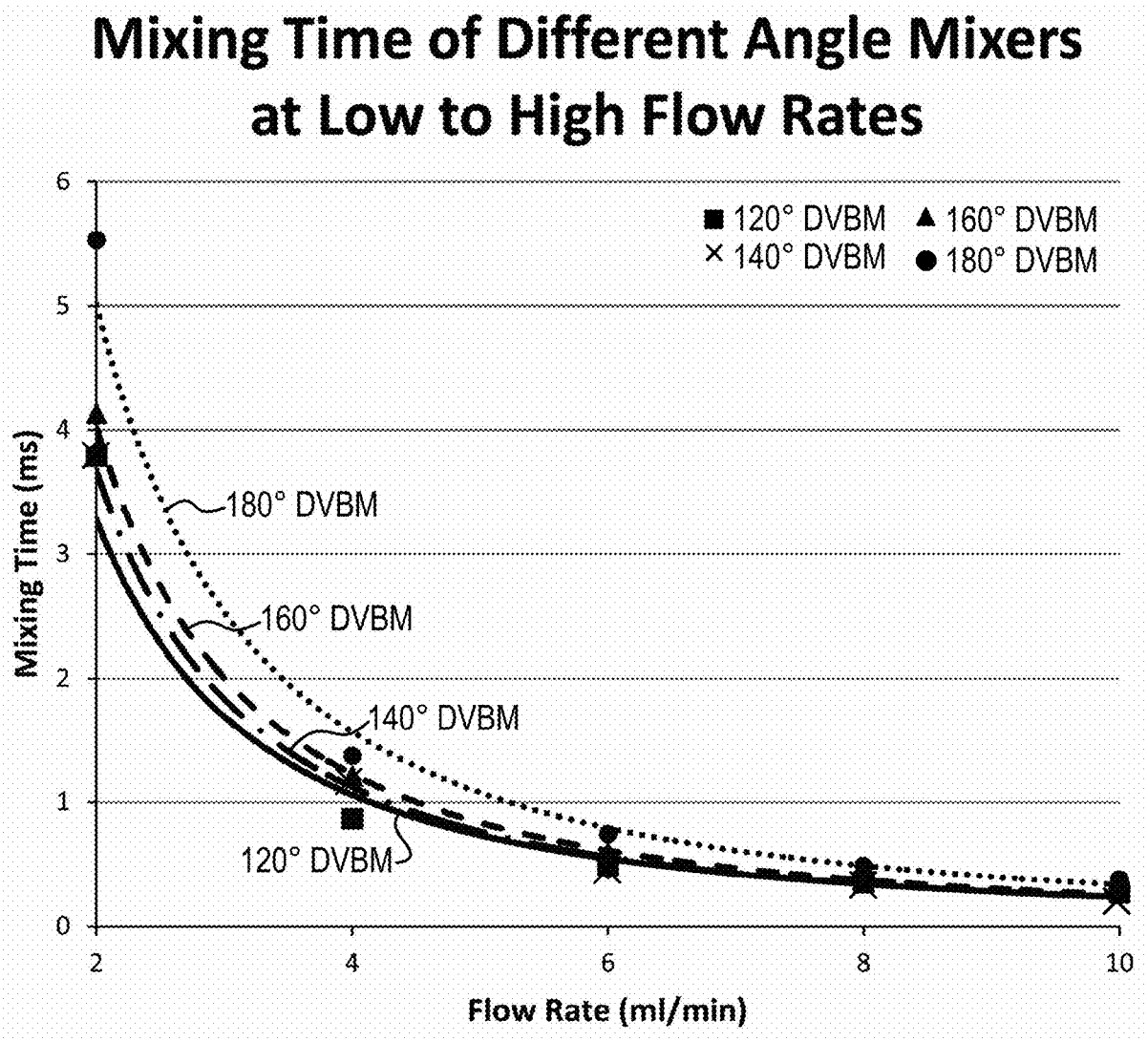
FIG. 7 graphically illustrates measured mixing time in exemplary DVBM at various neck angles.

In order to optimize performance, a set of four Exemplary DVBM mixers with offset angles of 120°, 140°, 160° and 180° were prototyped. Mixing speed was optically measured for a series of flow rates (FIG. 7). From this testing it was confirmed that offset angle was a parameter for improving mixing speed and that 120° was the optimal angle. As such, a DVBM with a 120° was used for comparison against mixers Type 1-3.

Samples were imaged using a bright field stereoscope. To visualize mixing, 125 mM NaAc and 1 M NaOH containing bromothymol blue ("BTB") were used as the reagents. Mixing time was calculated by imaging the mixer with a colour CCD and locating the point at which there was an even yellow distribution across the channel. The mixing time for the device was then taken to be the time required for entering fluid to reach this point of complete mixture. See the Appendix for further details regarding experimental techniques used to measure mixing time.

Figure 8:
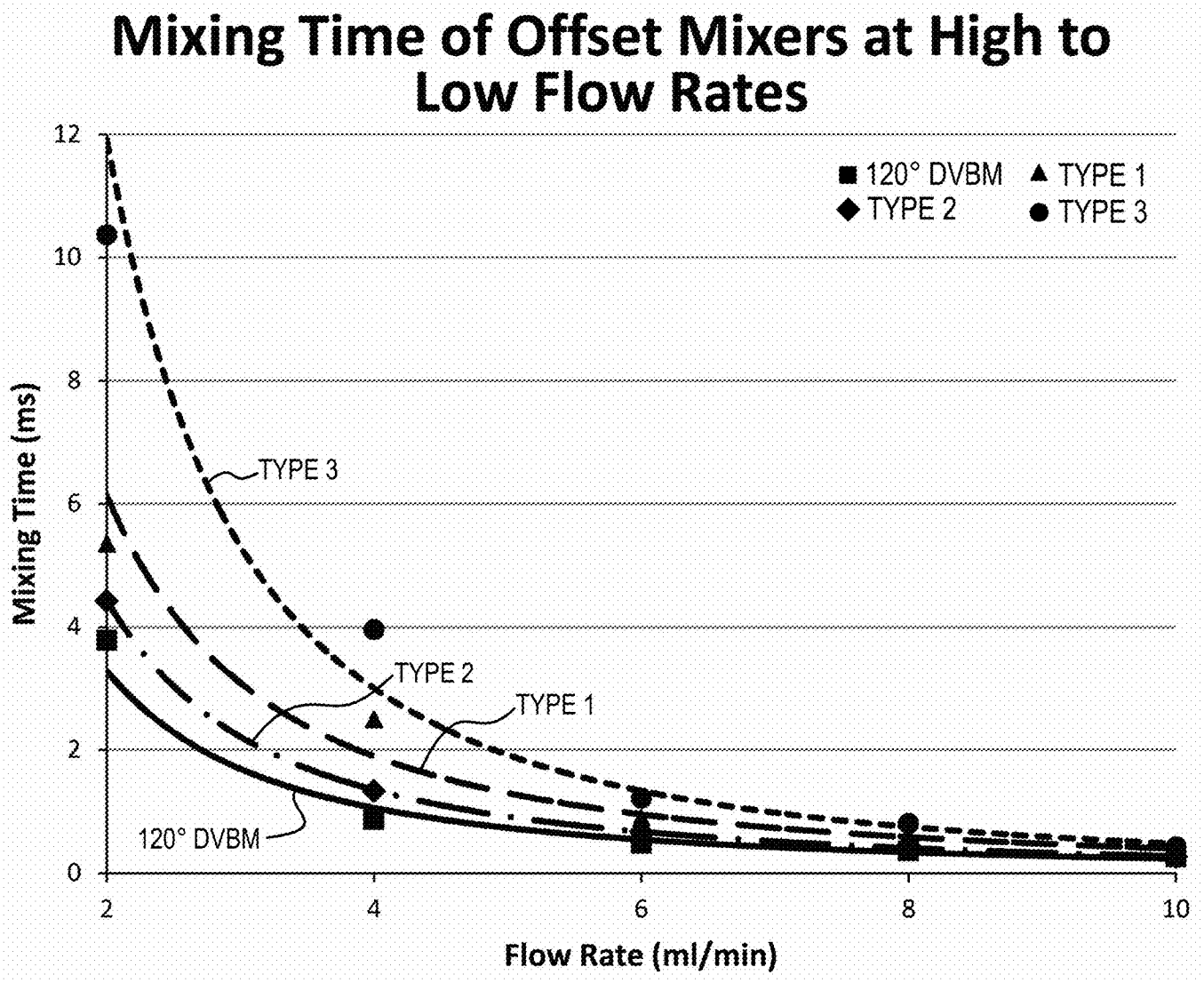
FIG. 8 graphically illustrates measured mixing time of exemplary and comparative DVBM mixers.

FIG. 8 shows the performance of the Types 1-3 and an Exemplary DVBM differ across as series of input flow rates (as measured by mixing time). Below 10 ml/min, both mixer Types 1 and 3 suffer from slower mixing than Type 2 or the Exemplary DVBM (as expected). Interestingly, not only does the Exemplary DVBM with 120° offset recover the performance of the Type 2 mixer at low flow rates it actually exceeds it. This is unexpected and non-obvious.

Lipid nanoparticles (of the type formed in the references incorporated in the section below) were formulated on both the 120 and 180 degree Exemplary DVBM mixers. Briefly, a lipid composition of POPC and Cholesterol were dissolved in ethanol at 55:45 molar ratio. The final lipid concentration was 16.9 mM. Flow rates between 2 and 10 ml/min were tested on a commercial NanoAssemblr Benchtop Microfluidic Cartridge (employing a SHM), 120 Degree Exemplary DVBM and a 180 Degree Exemplary DVBM, with the results illustrated in FIG. 9, below. Both Exemplary DVBM devices showed the same size vs. flow rate as the Cartridge. However, at low flow rate, the Exemplary DVBM mixers made smaller, less polydisperse particles than the Cartridge.

Figure 9:
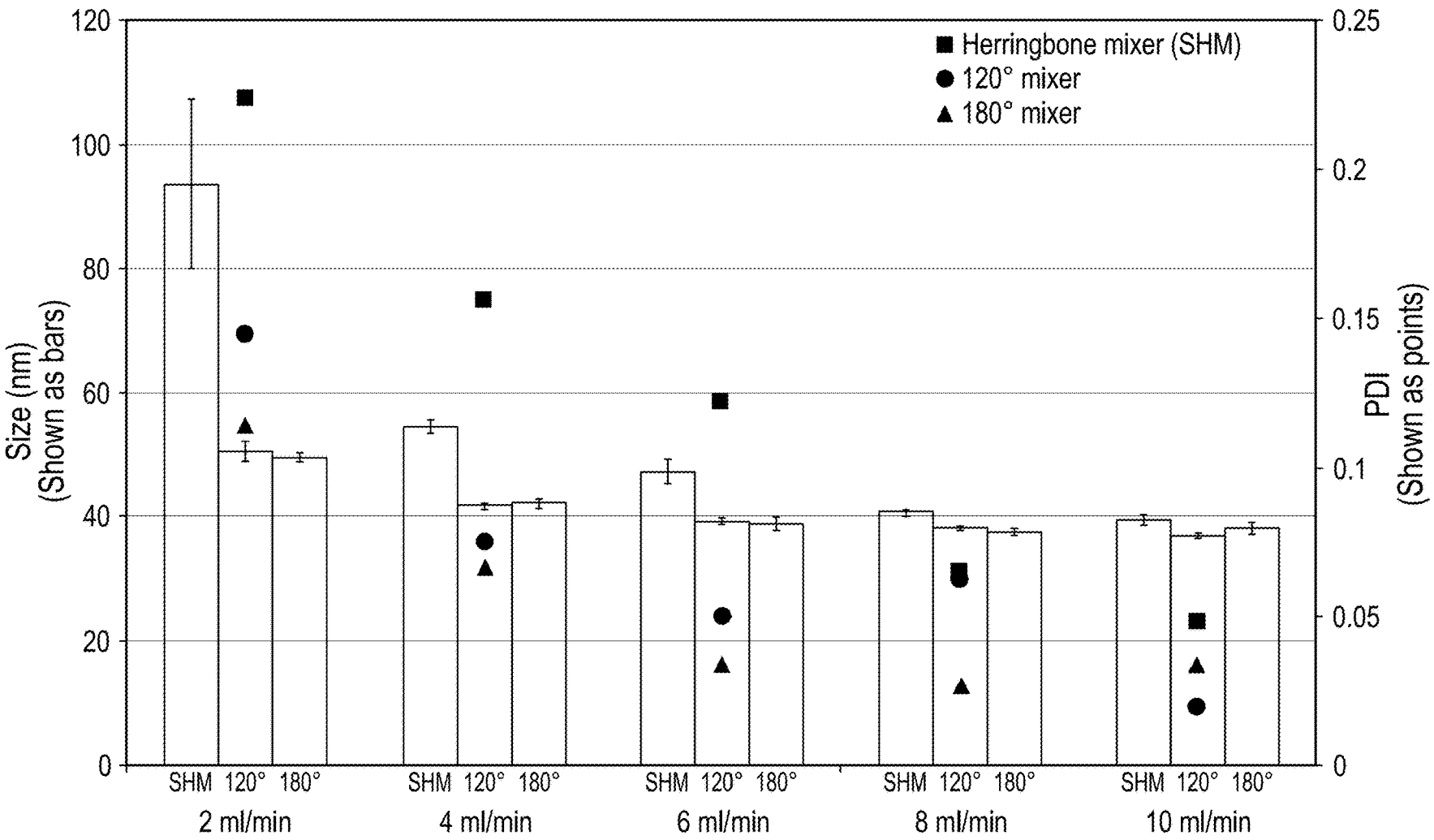
FIG. 9 graphically illustrates comparison of particle size and polydispersity index ("PDI") for a staggered herringbone mixer and two exemplary DVBM mixers.

FIG. 9 is a comparison of particle size and PDI for a staggered herringbone mixer and two DVBM designs. Particularly at higher flow rates it can be seen that the Exemplary DVBM mixers perform as well as the SHM mixers.

Mixing Time Calculations

The following equipment was used:

Amscope Camera

Amscope Microscope

White/Black Back Plate

PTFE tubing 1/32"

Dean Vortex Mixing Devices (PDMS on Glass Slide)

PetriDish

Stainless Steel Weights

Figure 10:
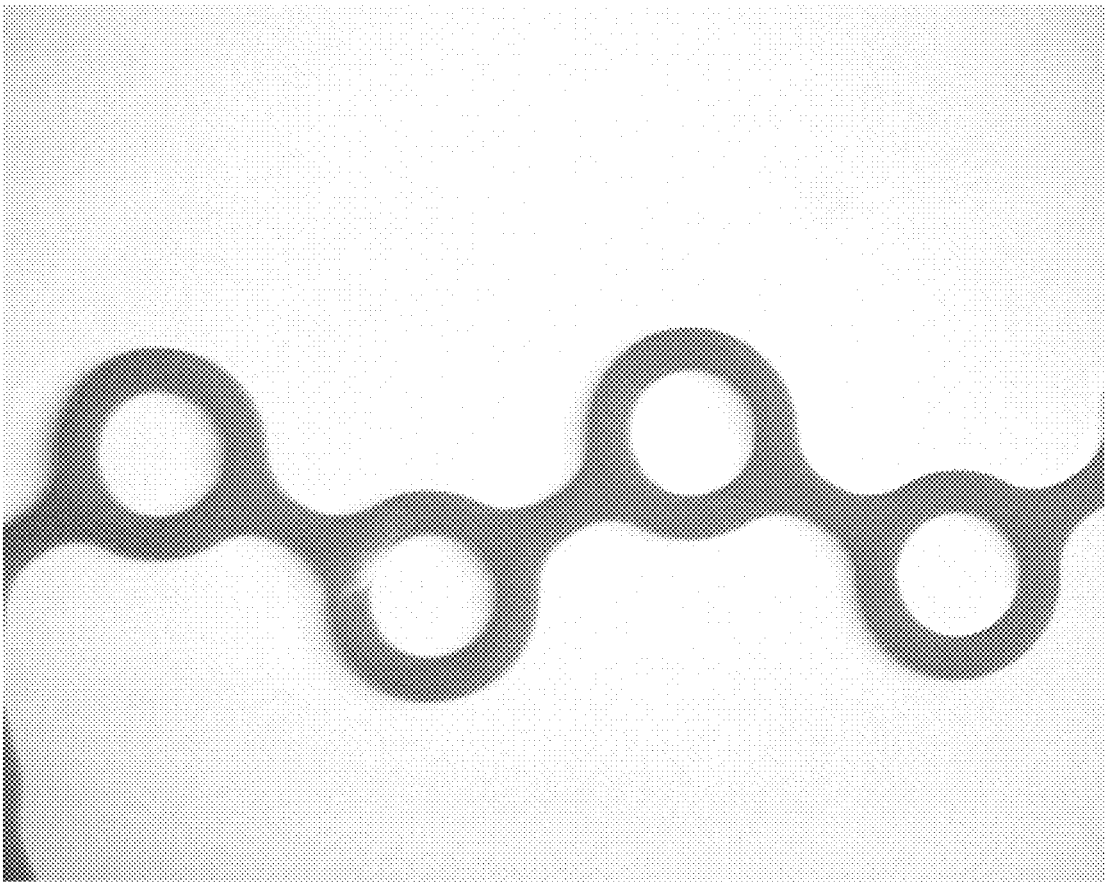
FIG. 10 is a micrograph of a DVBM mixer prior to mixing. Such an image serves as the "template" for image analysis.

Data was collected using an Amscope Microscope with an attached 56 LED illuminator and white base plate. A petri dish with weights attached was also put into the recording area to make adjusting device position easier. 125 mM NaAc and 1 M NaOH w/ BTB were mixed at a 3:1 ratio; full mixing was determined as the point at which the solution turned yellow with an even intensity distribution. All images from the same flow rate were taken without moving the Dean Vortex Mixer (see Processing Method). In order to better detect color changes, the imaging software was manually adjusted with Color Saturation set to maximum. FIG. 10 is a micrograph of a DVBM mixer prior to mixing.

Figure 11:
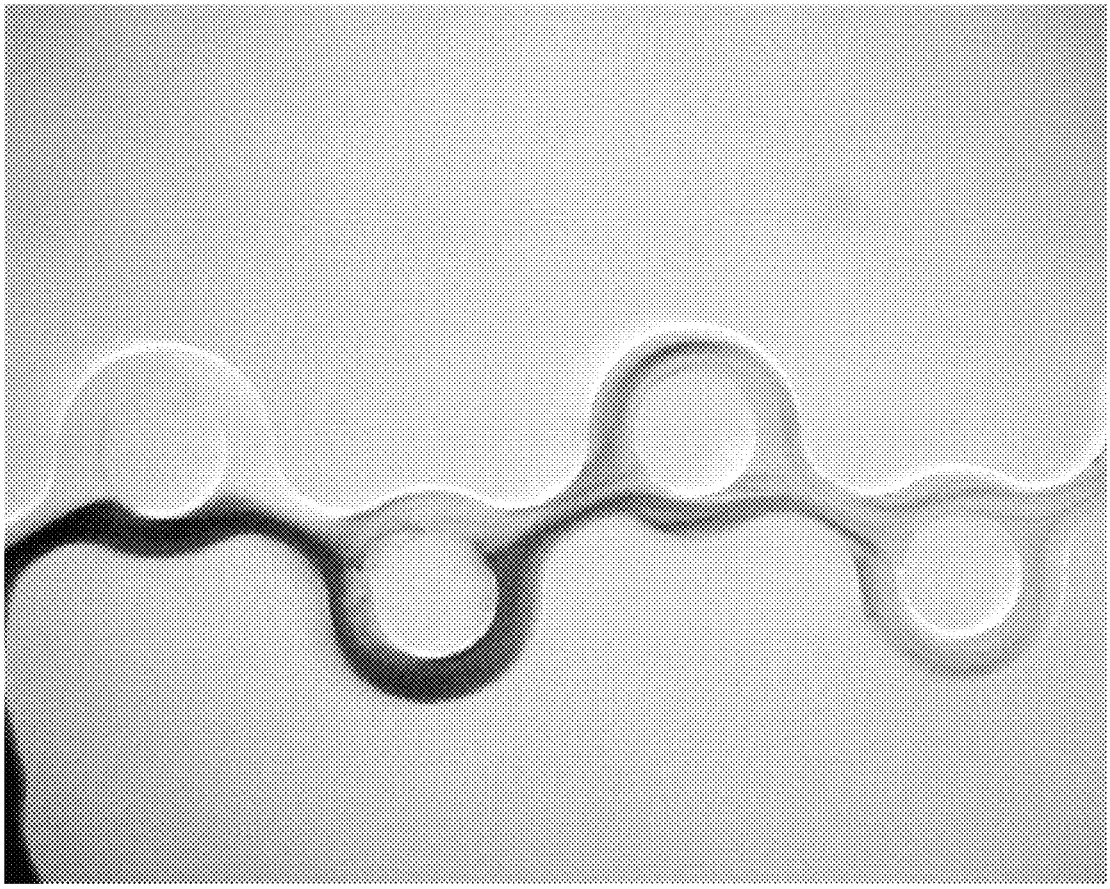
FIG. 11 is a micrograph of a DVBM mixer in operation, where a clear and a blue liquid are mixed to form a yellow liquid at the far right of the image (i.e., mixing is complete).

FIG. 11 is a micrograph of a DVBM mixer in operation, where a clear and a blue liquid are mixed to form a yellow liquid at the far right of the image (i.e., mixing is complete).

Processing Method

Figure 12:
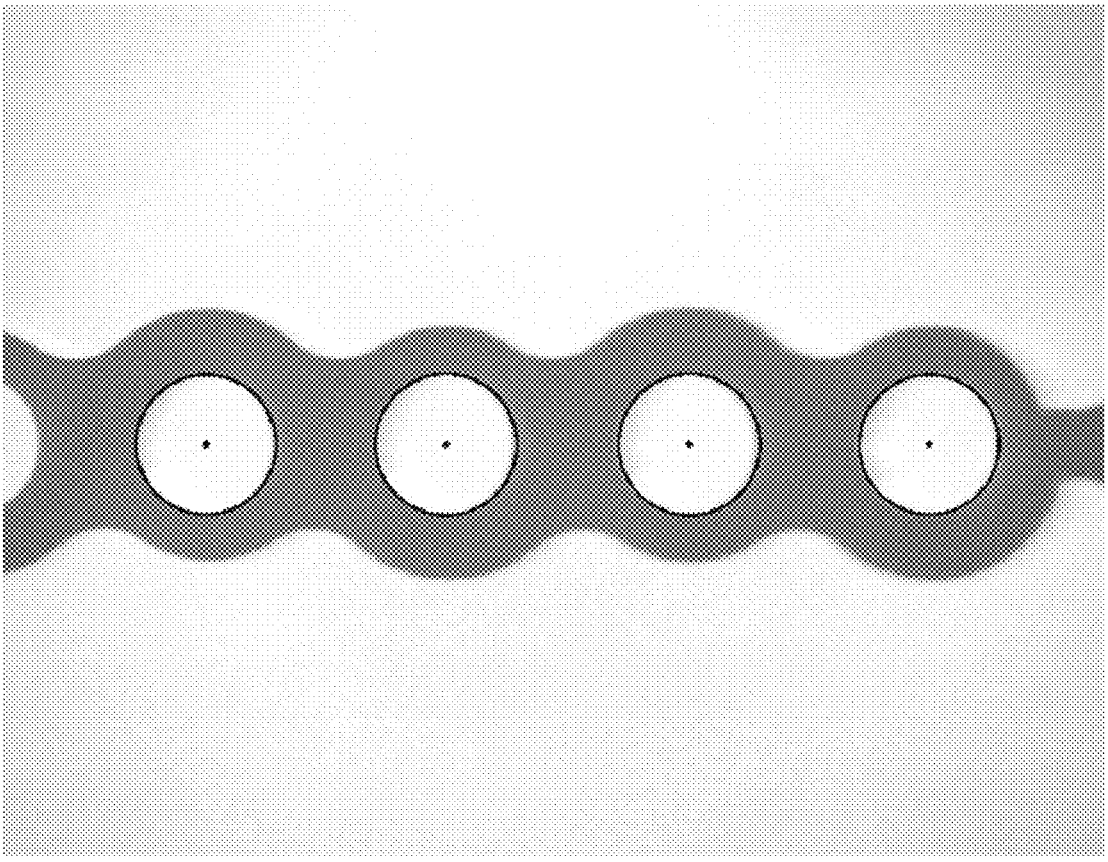
FIG. 12 is a micrograph showing circles detected using Hough Circle Transform.

Raw Images were put into a folder where a program using Python and OpenCV 3.0 was used to rotate, centre and stitch them. A template image was first processed (Using Hough Circle Transform (see FIG. 12) to detect circles within the image which were used as the basis for the transform calculations) and then the subsequent images had the same transformations carried out on them as the template. During this process, radius was also calculated and used to determine the pixel area of the image in micro metres.

Figure 13A:
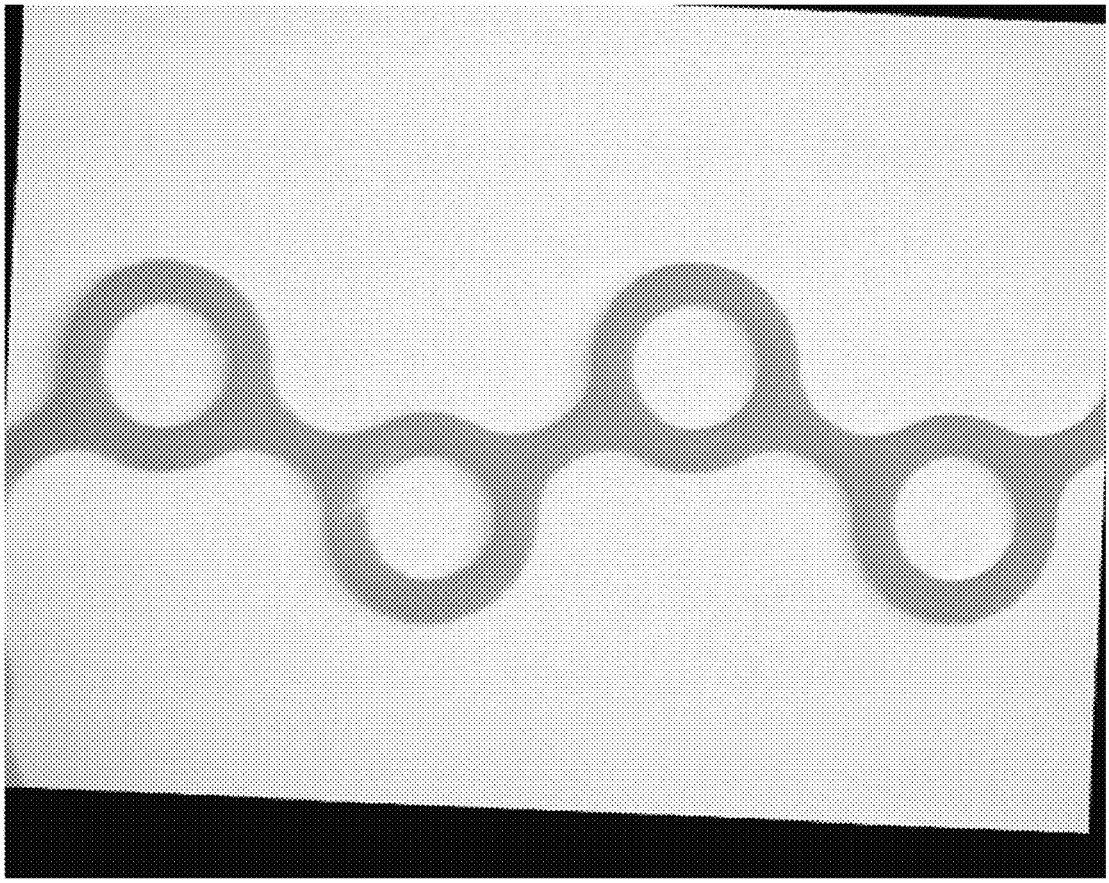
FIGS. 13A-13C are processed Template and Data images of mixers.
Figure 13B:
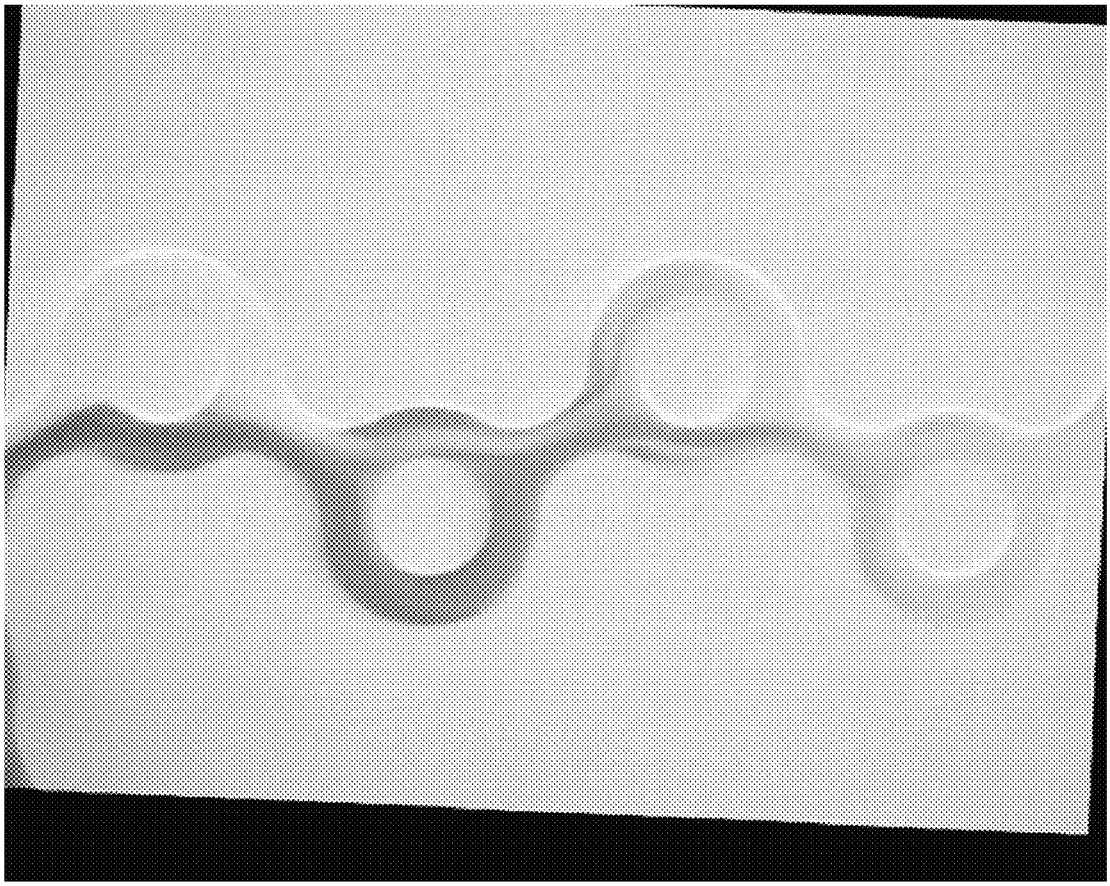
Figure 13C:
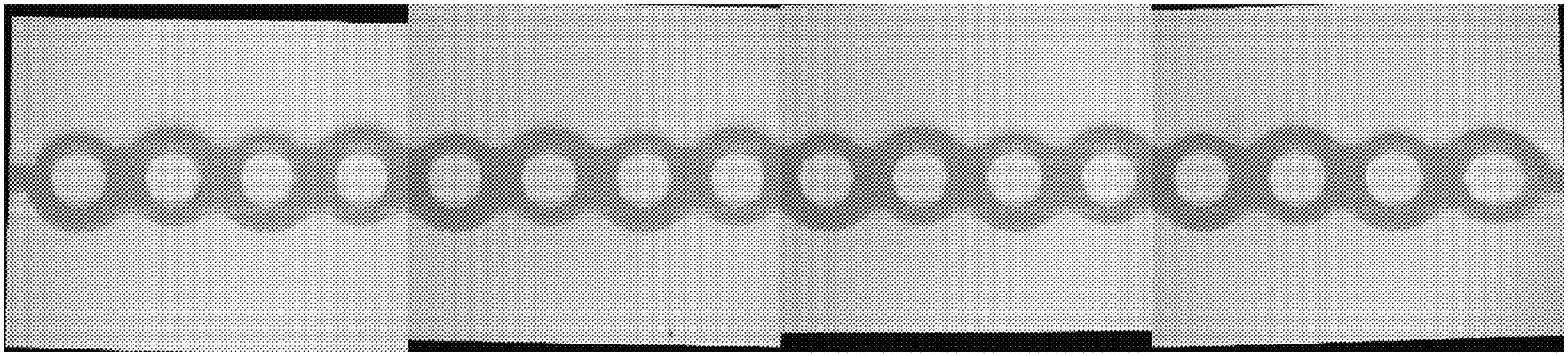

FIGS. 13A-13C are processed Template and Data images of mixers. FIG. 13A is a DVBM template image. FIG. 13B is a DVBM image during mixing. FIG. 13C is a template image of a non-DVBM mixer.

Calculation Method and Algorithm

Template image channels were detected by checking the value of each pixel for a specific color threshold (intensity of blue in this case) and then by changing the pixel color to black if their value was not within the threshold range. Through this method a mask was applied which only contained the channels of the mixer. The mixing image was then uploaded and the same mask applied to it. Visual confirmation was made of the mixing point and then a calculation range was input. Pixels within the channel up to this range were counted and coloured white. Volume was calculated from the pixel area which was previously determined and the height of the channels within the device. Once the total mixing volume was calculated, it was divided by the flow rate at which the device was mixed to determine the Mixing Time.

Figure 14:
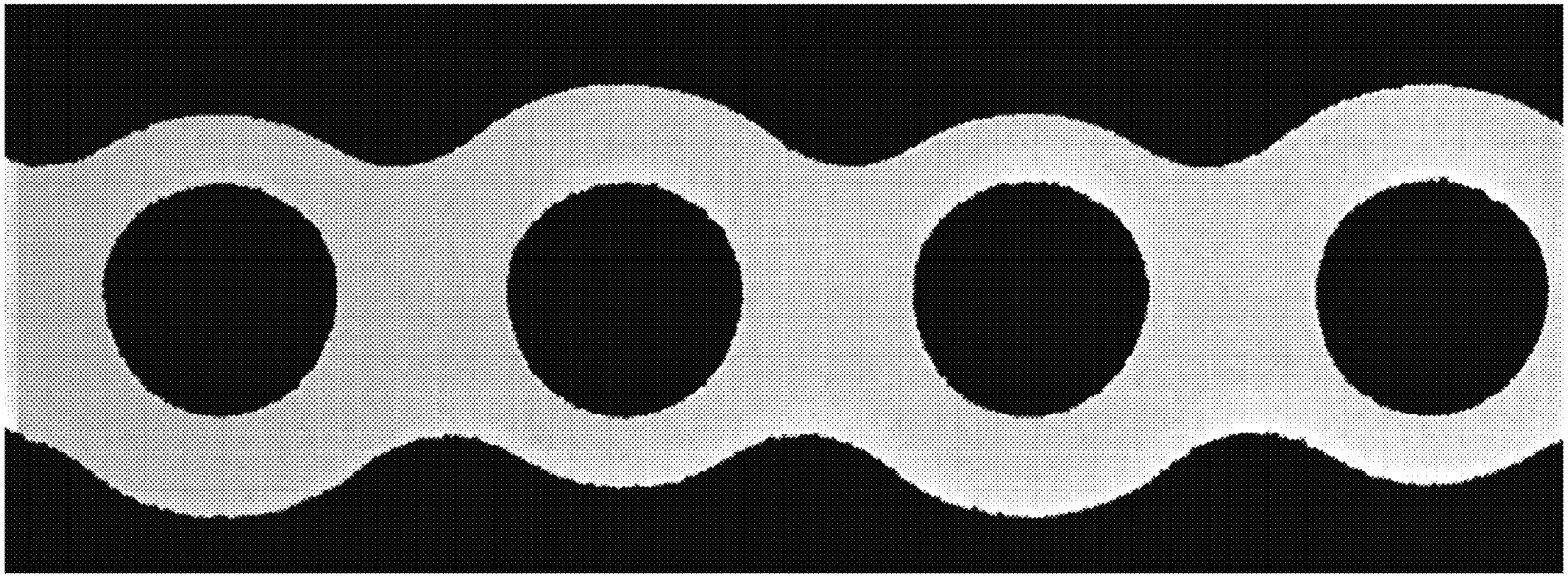
FIG. 14 is a Template image with a Mask applied.
Figure 15:
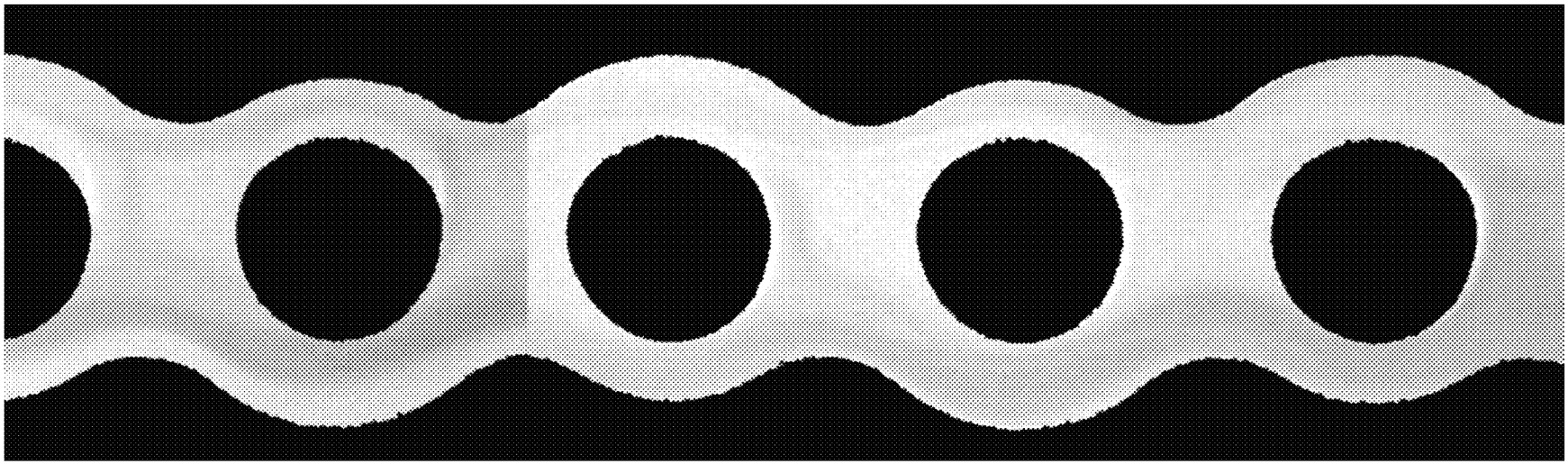
FIG. 15 is a Data (mixing) image with a Mask applied.
Figure 16:
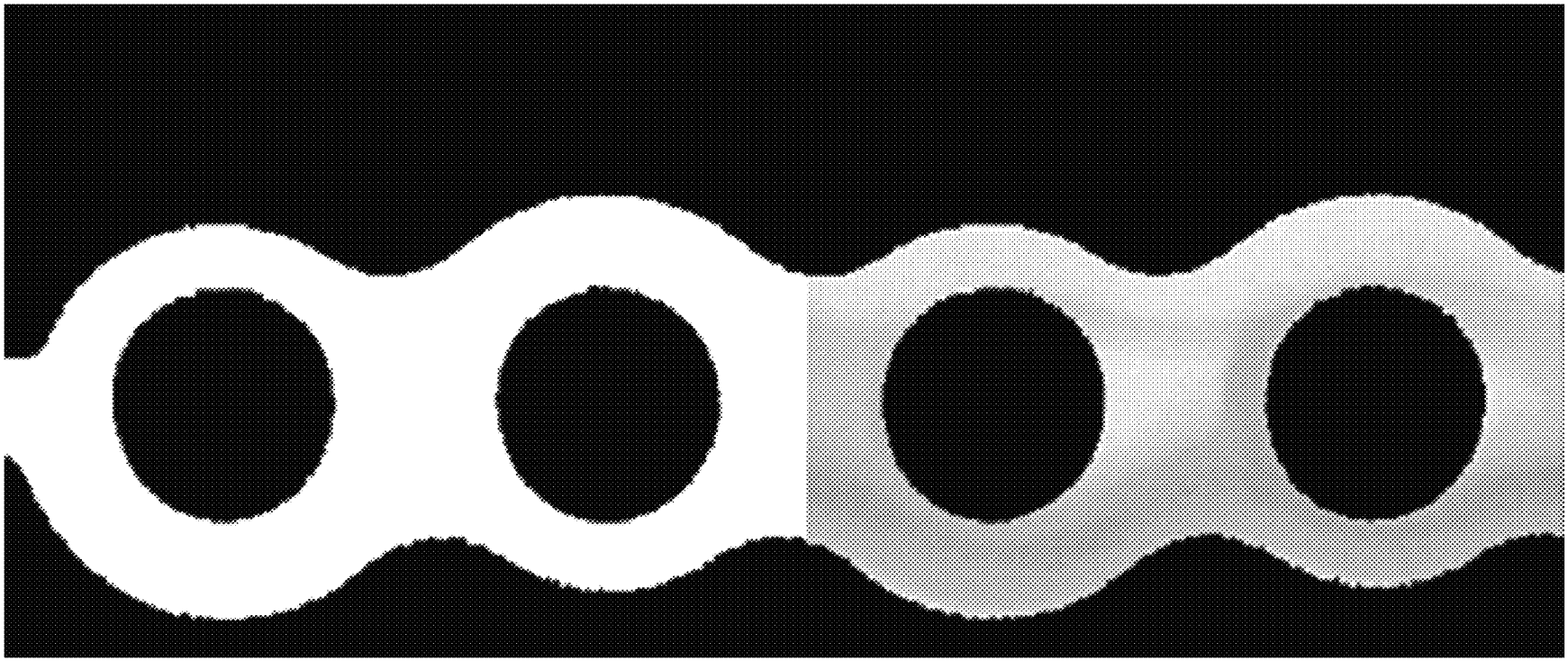
FIG. 16 is a Data (mixing) image with counted pixels in white.

FIG. 14 is a template image with a mask applied. FIG. 15 is a data (mixing) image with a mask applied. FIG. 16 is a data (mixing) image with counted pixels in white.

Liposome Production Using DVBM

Figure 17:
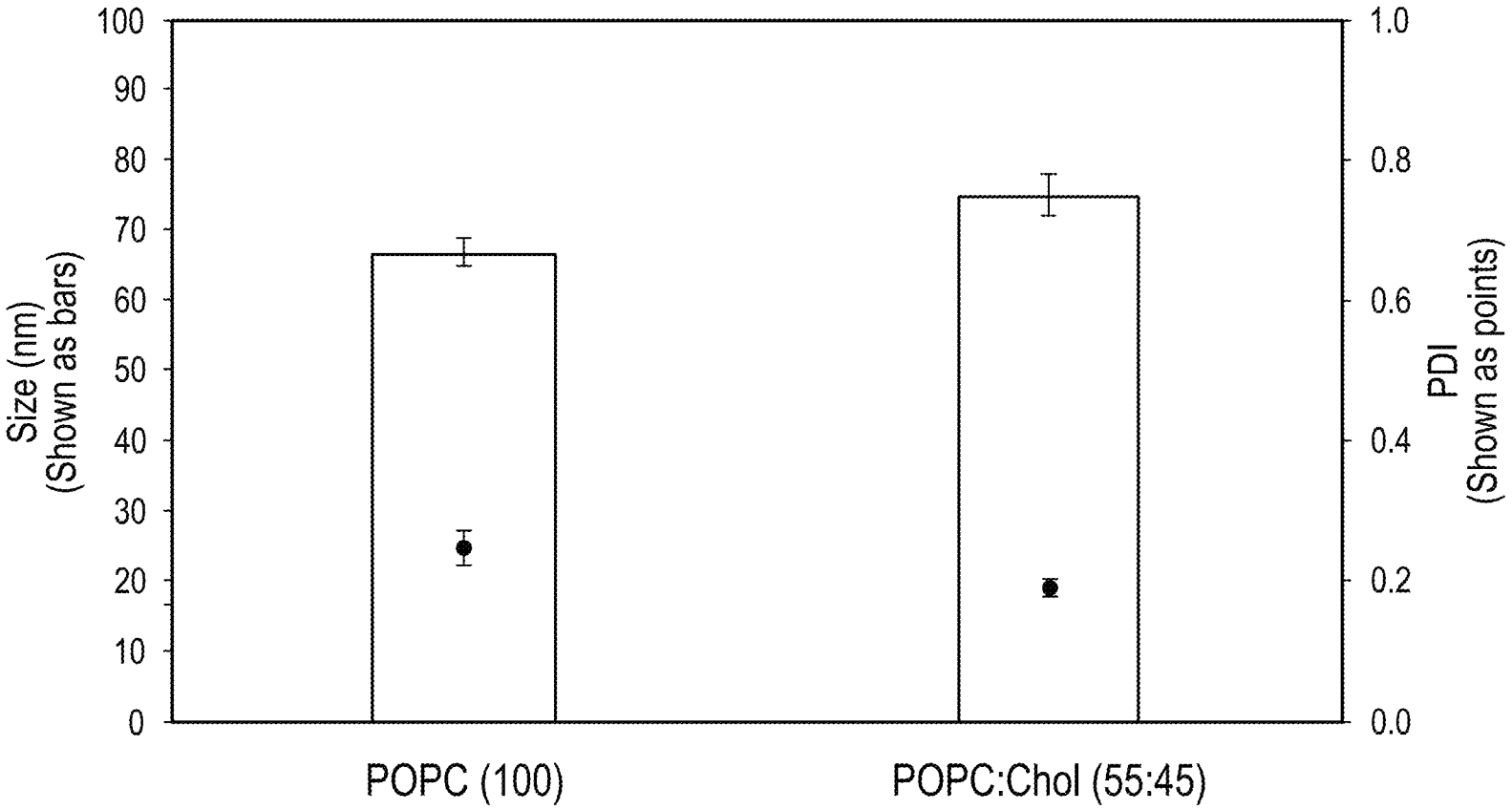
FIG. 17 graphically illustrates size and PDI characteristics of liposomes produced by representative DVBM in accordance with embodiments disclosed herein.

We produced liposomal vesicles below 100 nm in size with narrow PDI, as summarized in FIG. 17. FIG. 17 graphically illustrates size and PDI characteristics of liposomes produced by representative DVBM in accordance with embodiments disclosed herein. This data was produced on a DVBM device with a neck length of 0.25 mm, neck angle of 120 degrees, inside radius of 0.16 and channel width and height of 80 microns and a flow rate ratio of approximately 2:1 (aqueous:lipid). The lipid composition was pure POPC liposomes or POPC:Cholesterol (55:45)-containing liposomes. The initial lipid mix concentration was 50 mM. The aqueous phase included PBS buffer.

Materials and Methods:

POPC (1-palmitoyl-2-oleoyl-sn-glycero-3-phosphocholine) was from Avanti Polar Lipids, Inc, USA. Cholesterol, Triolein, C-6 (Coumarin-C6), DMF (Dimethyl Formamide), PVA, [Poly (Vinyl Alcohol), Mowiol® 4-88] and PBS (Dulbecco's phosphate buffered saline) were from Sigma-Aldrich, USA. Ethanol was from Green Field Speciality Alchols Inc, Canada. PLGA, Poly (lactic co-glycolic acid) was from PolyciTech, USA.

The following solutions were dispensed into the respective wells in the cartridge. 36 μL PBS into aqueous reagent well, 48 μL of PBS in the collection well, and lastly, just before mixing through the chip, 12 μL of 50 mM lipid mix in ethanol into the organic reagent well. The reagent solutions were micro-mixed. The particles generated are diluted 1:1 with PBS.

Emulsion Production Using DVBM

Figure 18:
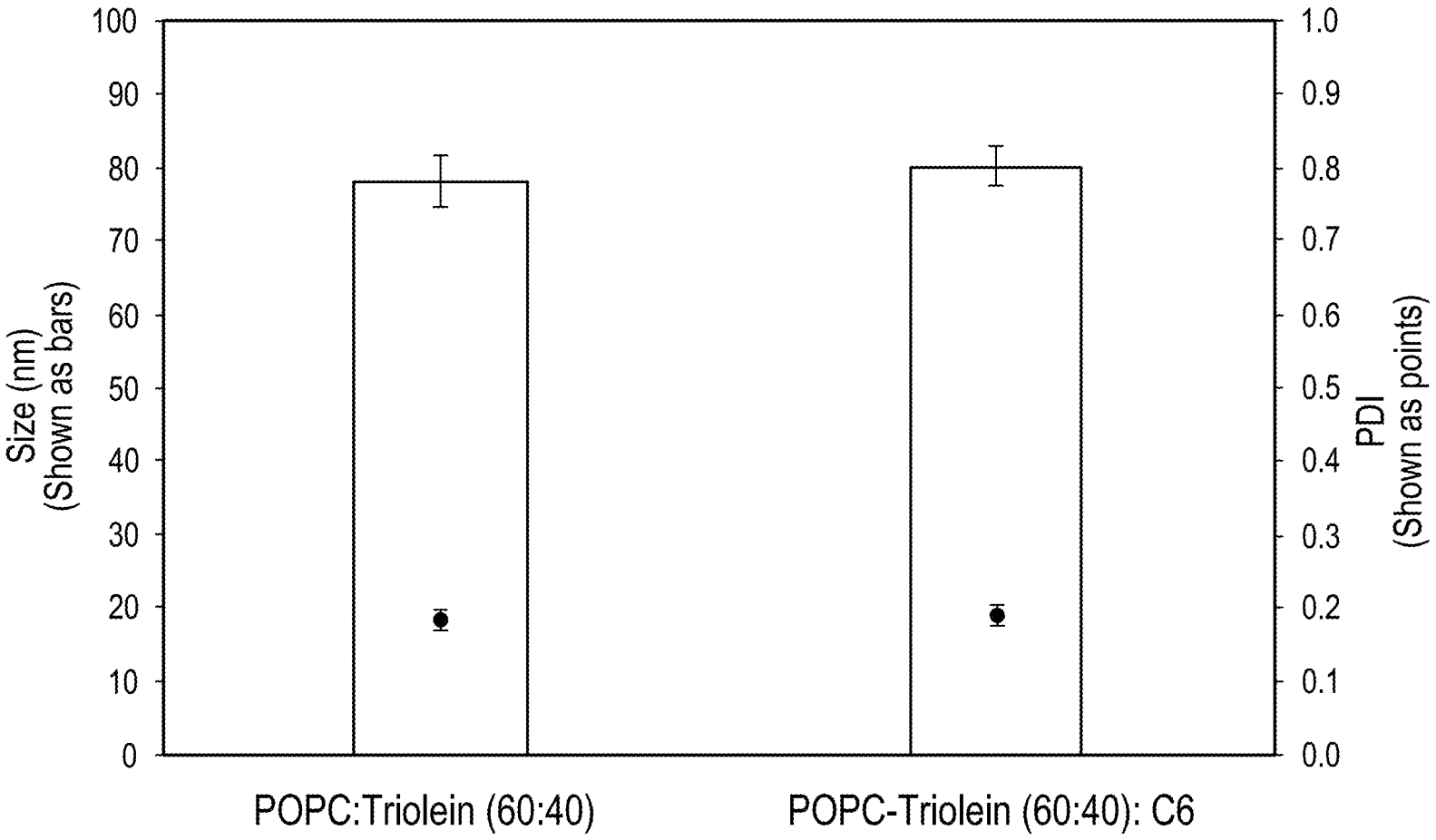
FIG. 18 graphically illustrates size and PDI characteristics of an emulsion encapsulated therapeutic particle produced by representative DVBM in accordance with embodiments disclosed herein, and a comparison to a non-therapeutic-containing emulsion particle of otherwise similar composition.

We produced an emulsion below 100 nm in size with narrow PDI, as summarized in FIG. 18. FIG. 18 ("POPC: Triolein (60:40)") graphically illustrates size and PDI characteristics of liposomes produced by representative DVBM in accordance with embodiments disclosed herein. This data was produced on a DVBM device with a neck length of 0.25 mm, neck angle of 120 degrees, inside radius of 0.16 and channel width and height of 80 microns and a flow rate ratio of approximately 2:1 (aqueous:lipid mix). The lipid composition was POPC:Triolein (60:40). The initial lipid mix concentration was 50 mM. The aqueous phase included PBS buffer.

Materials and Methods:

Same as described above with regard to liposomes.

Therapeutic Encapsulation in Emulsion Using DVBM

We produced a model hydrophobic drug, Coumarin-6, encapsulated during the production of emulsions, with a particle size below 100 nm and a narrow PDI, as illustrated in FIG. 18. FIG. 18 ("POPC-Triolein (60:40):C6") graphically illustrates size and PDI characteristics of an encapsulated therapeutic, Coumarin-6 produced by representative DVBM in accordance with embodiments disclosed herein, and a comparison to a non-therapeutic-containing particle of otherwise similar composition. This data was produced on a DVBM device with a neck length of 0.25 mm, neck angle of 120 degrees, inside radius of 0.16 and channel width and height of 80 microns and a flow rate ratio of approximately 2:1 (aqueous:lipid mix). The lipid mix composition was POPC:Triolein (60:40) 50 mM and Coumarin-6 in DMF with a D/L (drug/lipid) ratio of 0.024 wt/wt. The aqueous phase included PBS buffer. The "emulsion-only" nanoparticles formed without Coumarin-6 are essentially identical in size and PDI.

Materials and Methods:

Same as described above with regard to liposomes.

Polymer Nanoparticles Formed Using DVBM

Figure 19:
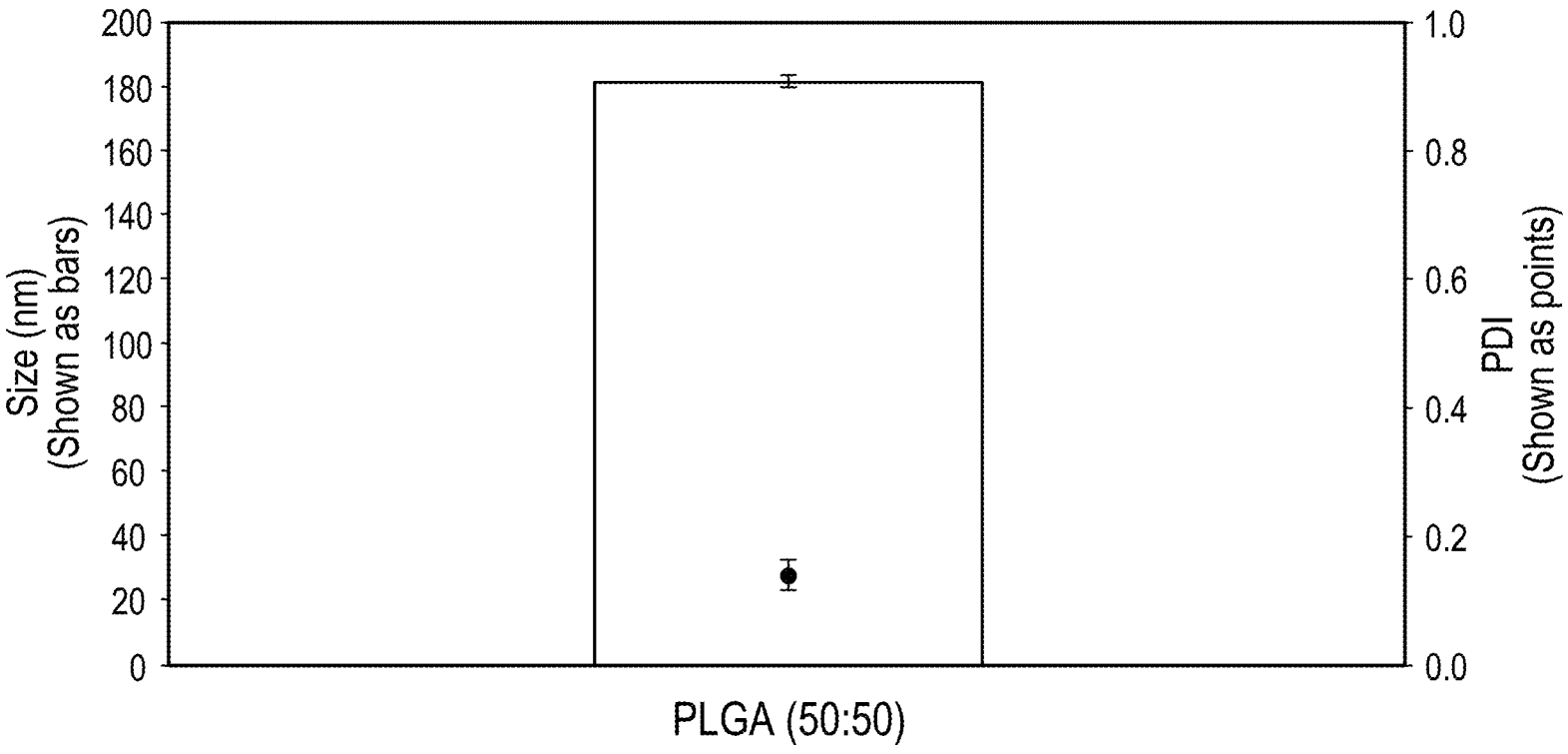
FIG. 19 graphically illustrates size and PDI characteristics of polymer nanoparticles produced by representative DVBM in accordance with embodiments disclosed herein.

We produced an emulsion below 200 nm in size with narrow PDI, as summarized in FIG. 19. FIG. 19 graphically illustrates size and PDI characteristics of polymer nanoparticles produced by representative DVBM in accordance with embodiments disclosed herein. This data was produced on a DVBM device with a neck length of 0.25 mm, neck angle of 120 degrees, inside radius of 0.16 and channel width and height of 80 microns and a flow rate ratio of approximately 2:1 (aqueous:polymer mix). The polymer mix includes poly (lactic-co-glycolic acid) ("PLGA") 20 mg/mL in acetonitrile. The aqueous phase included PBS buffer.

Materials and Methods:

Same materials as described above with regard to liposomes. The following solutions were dispensed into the respective wells in the cartridge. 36 μL 2% PVA wt/vol in MilliQ water into aqueous reagent well, 48 μL of MilliQ water in the collection well, and lastly, just before mixing through the chip, 12 μL of 20 mg/mL PLGA in acetonitrile into the organic reagent well. The reagent solutions were micro-mixed. The particles generated are diluted 1:1 with MilliQ water.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method of mixing a first liquid with a second liquid, comprising:

flowing the first liquid and the second liquid into an inlet channel of a mixer to form a combined flow;

bifurcating the combined flow around a first toroidal mixer of the mixer into a first curved flow and a second curved flow;

recombining the first curved flow and the second curved flow into the combined flow in a neck region downstream of the first toroidal mixer;

bifurcating the combined flow around a second toroidal mixer of the mixer into a third curved flow and a fourth curved flow; and recombining the third curved flow and the fourth curved flow into the combined flow downstream of the second toroidal mixer to form a mixed solution;

wherein a first volume ratio of the first curved flow to the second curved flow differs from a second volume ratio of the third curved flow to the fourth curved flow.

2. The method of claim 1, wherein the mixer is incorporated into a microfluidic device that includes a plurality of mixers, and the method further comprises flowing the first liquid and the second liquid through the plurality of mixers to form the mixed solution.

3. The method of claim 1, wherein the first liquid comprises a nucleic acid in a first solvent.

4. The method of claim 1, wherein the second liquid comprises lipid particle-forming materials in a second solvent.

5. The method of claim 1, wherein the mixed solution includes particles produced by mixing the first liquid and the second liquid.

6. The method of claim 5, wherein the particles are selected from the group consisting of lipid nanoparticles and polymer nanoparticles.

7. The method of claim 1, wherein the first volume ratio is 1:1 to 10:1.

8. The method of claim 1, wherein the first curved flow and the second curved flow have different lengths.

9. The method of claim 1, wherein the first curved flow and the third curved flow have different lengths and are located on different sides of the mixer.

10. The method of claim 1, wherein the first curved flow and the second curved flow have different widths.

11. The method of claim 1, wherein the first curved flow, the second curved flow, the third curved flow, and the fourth curved flow have different widths.

12. The method of claim 1, wherein the first curved flow and the third curved flow are located on different sides of the mixer.

13. The method of claim 1, wherein the first curved flow and the third curved flow have a same volume.

14. The method of claim 1, wherein the mixed solution has a Reynolds number of less than 2000.

15. The method of claim 1, wherein the first curved flow and the second curved flow have a first combined length equal to a circumference of the first toroidal mixer, and the third curved flow and the fourth curved flow have a second combined length equal to a circumference of the second toroidal mixer.

16. The method of claim 1, wherein at least one of the first curved flow or the second curved flow have a variable radius.

17. The method of claim 1, wherein the first toroidal mixer defines a first neck angle of 90 to 150 degrees between a center of the inlet channel and a center of the neck region.

18. A method of mixing a first liquid with a second liquid, comprising:

flowing the first liquid and the second liquid into an inlet channel of a mixer to form a combined flow;

bifurcating the combined flow around a first toroidal mixer of the mixer into a first curved flow and a second curved flow; and recombining the first curved flow and the second curved flow into the combined flow in a neck region downstream of the first toroidal mixer;

wherein the first toroidal mixer defines a neck angle of 90 to 150 degrees between a center of the inlet channel and a center of the neck region.

19. The method of claim 18, wherein the neck angle is 100 to 140 degrees.

20. The method of claim 18, further comprising:

bifurcating the combined flow around a second toroidal mixer of the mixer, downstream of the first toroidal mixer, into a third curved flow and a fourth curved flow; and recombining the third curved flow and the fourth curved flow into the combined stream downstream of the second toroidal mixer.

* * * * *